US005433292A

United States Patent [19]

Haymore et al.

[11] Patent Number: 5,433,292

[45] Date of Patent: Jul. 18, 1995

[54] STACKER

[75] Inventors: Ralph B. Haymore, Salt Lake City; Mark I. Johnson, Lehi, both of Utah

[73] Assignee: HK Systems, Inc., Brookfield, Wis.

[21] Appl. No.: 112,120

[22] Filed: Aug. 26, 1993

[51] Int. Cl.[6] ..... B66B 9/20

[52] U.S. Cl. ..... 187/235; 187/240; 52/292

[58] Field of Search ..... 187/9 R, 9 E, 11, 89, 187/73, 235, 240; 52/292, 296; 414/279, 266, 281

[56] References Cited

U.S. PATENT DOCUMENTS

| | | | |
|---|---|---|---|
| 3,163,264 | 12/1964 | Gondry | 52/292 |
| 3,606,222 | 9/1971 | Howard | 52/292 |
| 4,421,209 | 12/1983 | Vermette et al. | 187/9 R |
| 4,958,440 | 9/1990 | Pipes | 33/645 |
| 5,005,912 | 4/1991 | Pipes | 301/111 |

*Primary Examiner*—Kenneth W. Noland
*Attorney, Agent, or Firm*—Jeffrey S. Sokol; Godfrey & Kahn

[57] ABSTRACT

An improved stacker assembly includes a base assembly and a hollow mast which extends upwardly from the base assembly. A cap assembly is disposed on the upper end portion of the hollow mast. A carriage is movable up and down along the mast to raise and lower a load. The base assembly includes an upwardly extending mast support assembly which is telescopically received in the lower end portion of the hollow mast. The mast support assembly includes a gripper assembly which is operable to grip the inside of the lower end portion of the hollow mast. The cap assembly includes a downwardly extending cap support which is telescopically received in an upper end portion of the hollow mast and is expandable to grip the inside of the hollow mast. In the event of a loss of tension in a support cable for the carriage, a brake assembly on the carriage grips elongated brake bars which are separate from the mast to support the carriage. The brake bars are suspended from the cap assembly and are spaced apart from the mast throughout the length of the brake bars. The base assembly has accurately located wheel mounting surfaces.

79 Claims, 10 Drawing Sheets

STACKER

BACKGROUND OF THE INVENTION

The present invention relates to a new and improved stacker having a carriage which is movable up and down along a mast to raise and lower a load.

Known stackers have previously been assembled for the first time at warehouses or other sites where the stackers are to be used. During the on-site assembly of a stacker for the first time, precision instruments are required to align the various components of the stacker. The aligning and interconnecting of components of the stacker requires highly skilled labor and relatively complicated equipment at the site where the stacker is assembled.

SUMMARY OF THE INVENTION

The present invention relates to a new and improved stacker having a hollow mast which extends upwardly from a base assembly. A carriage is movable along the mast to raise and lower a load. The base assembly includes an upwardly extending mast support which is telescopically received in a lower end portion of the hollow mast. A gripper assembly is provided to expand the mast support to grip the inside of the hollow mast.

A cap assembly is disposed on an upper end portion of the mast. The cap assembly advantageously includes a downwardly extending mounting section which is telescopically received in an upper end portion of the hollow mast. The downwardly extending mounting section is expandable to grip the inside of the mast.

A brake assembly is provided to hold the carriage against downward movement along the mast in the event of a loss of tension in a cable which supports the carriage. The brake assembly advantageously includes a pair of elongated brake elements or bars which are suspended from the cap assembly in a spaced apart relationship with the mast. Brake members on the carriage are operable to grip the elongated brake elements and thereby support the carriage, in the event of a loss of tension in the cable.

Assembly of the stacker, at a location where the stacker is to be used, is facilitated by forming a frame of the stacker with accurately located wheel mounting surfaces. This enables wheel mounting units to be connected directly to the frame of the stacker.

BRIEF DESCRIPTION OF THE DRAWINGS

The foregoing and other features of the invention will become more apparent upon a consideration of the following description taken in connection with the accompanying drawings wherein.

DESCRIPTION OF ONE SPECIFIC PREFERRED EMBODIMENT OF THE INVENTION

General Description

Figure 1:
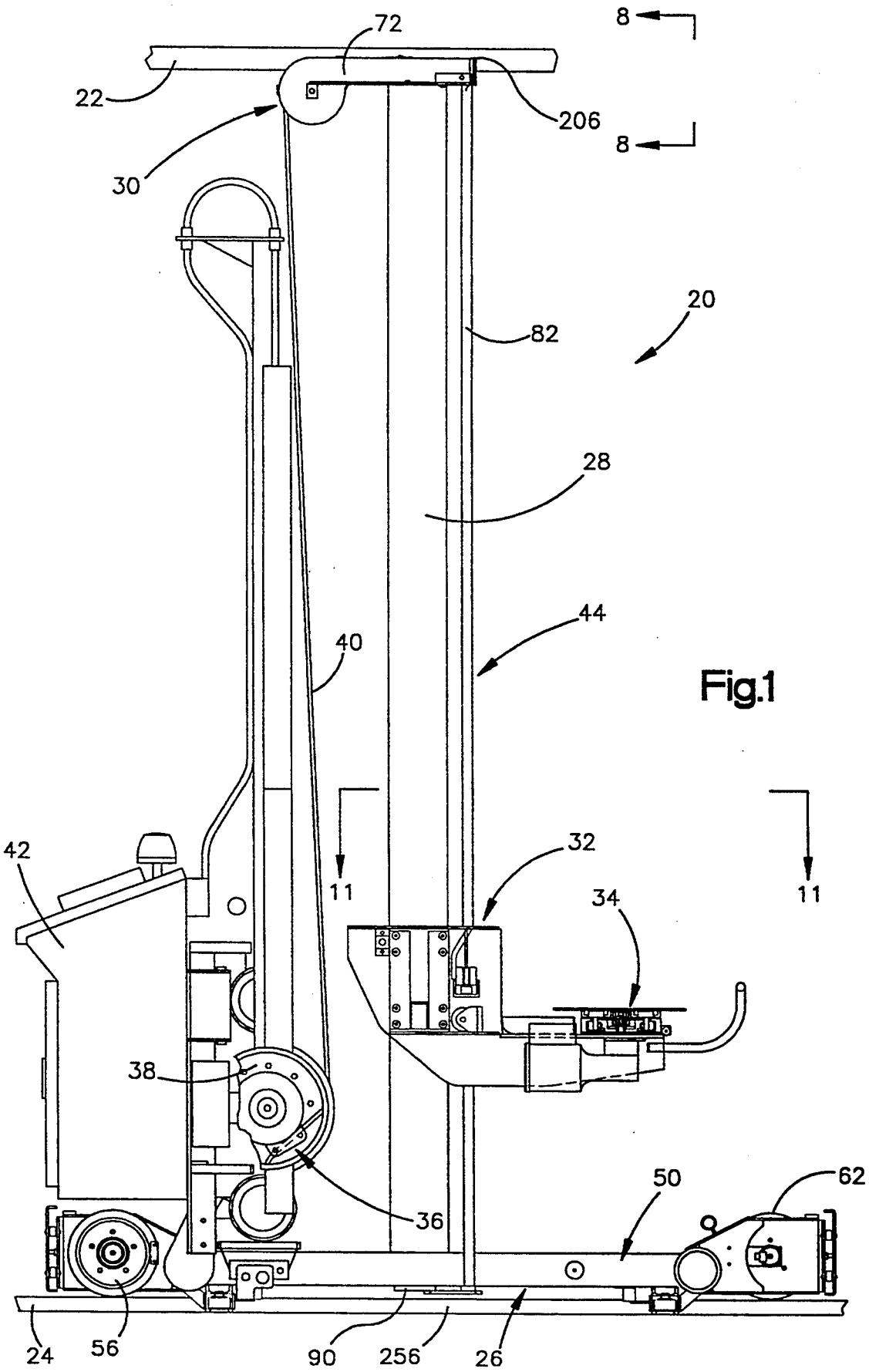
FIG. 1 is a side elevational view of a stacker constructed in accordance with the present invention.

A stacker 20 for use in an automated warehouse or other facility is illustrated in FIG. 1. The stacker 20 is movable along parallel upper and lower guide rails 22 and 24 to move loads to and from storage locations in a warehouse in a known manner.

In accordance with one of the features of the present invention, the stacker 20 is first constructed at a location remote from the warehouse or other location where the stacker is to be used. The stacker 20 is then disassembled and shipped to the warehouse or other location where the stacker is to be used. The stacker 20 is then reassembled at the location where it is to be used. The stacker 20 is constructed so that it can be reassembled with a minimum of highly skilled personnel and complicated equipment.

The stacker 20 includes a base assembly 26. A hollow mast 28 extends vertically upwardly from the base assembly 26 to a cap assembly 30. A carriage 32 is movable up and down along the mast 28 to raise and lower a load disposed on a shuttle assembly 34.

A winch assembly 36 is mounted on the base assembly 26. The winch assembly 36 includes a drum 38 from which a cable 40 extends upwardly to the cap assembly 30. The cable 40 extends downwardly from the cap assembly 30 to the carriage 32. Suitable automatic controls 42 are mounted on a rearward portion of the base assembly 26. A brake system 44 is provided to retain the carriage 32 against downward movement along the mast 28 in the unlikely event of a loss of tension in the cable 40.

Figure 2:
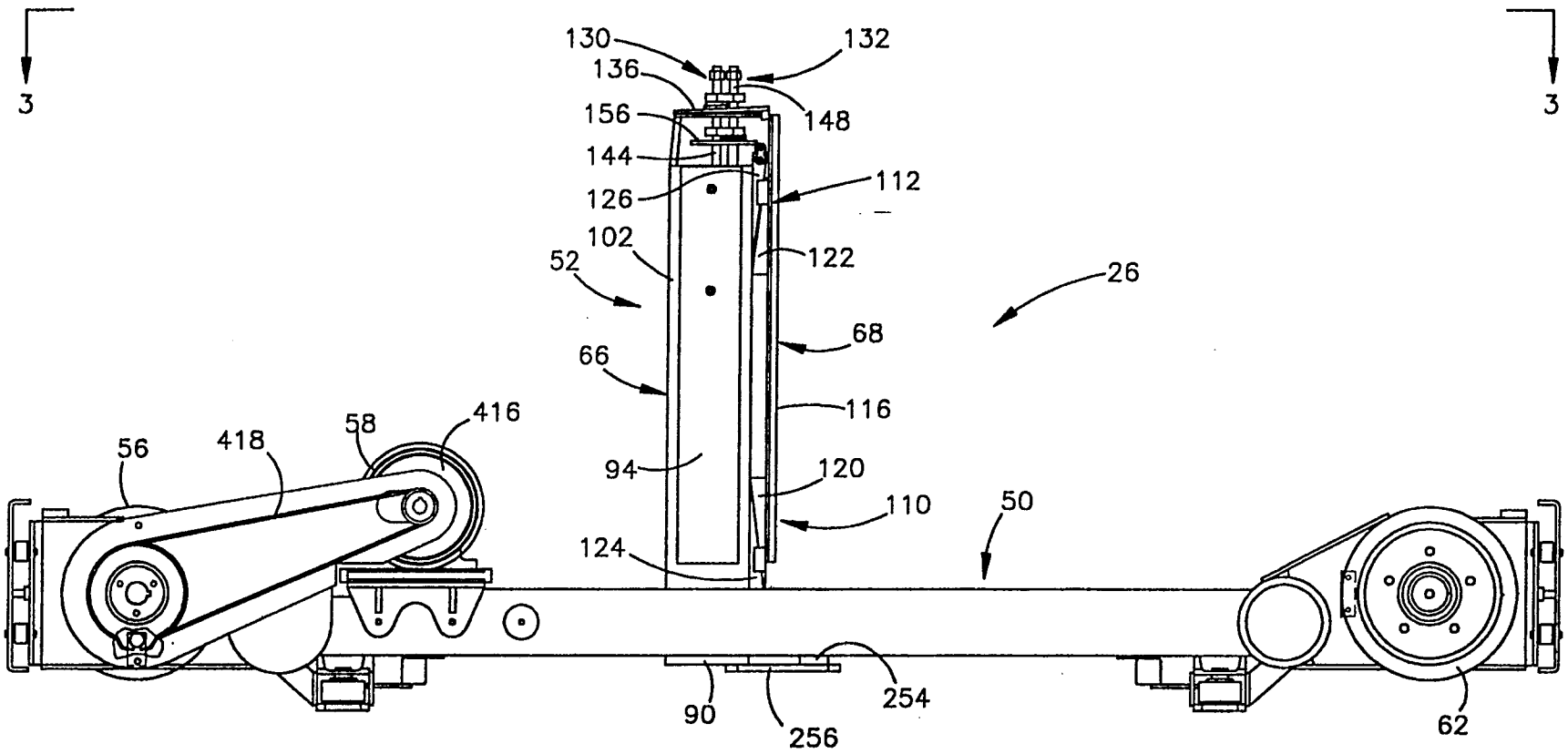
FIG. 2 is an enlarged side elevational view of a base assembly used in the stacker of FIG. 1 and having an upwardly extending mast support assembly.
Figure 3:
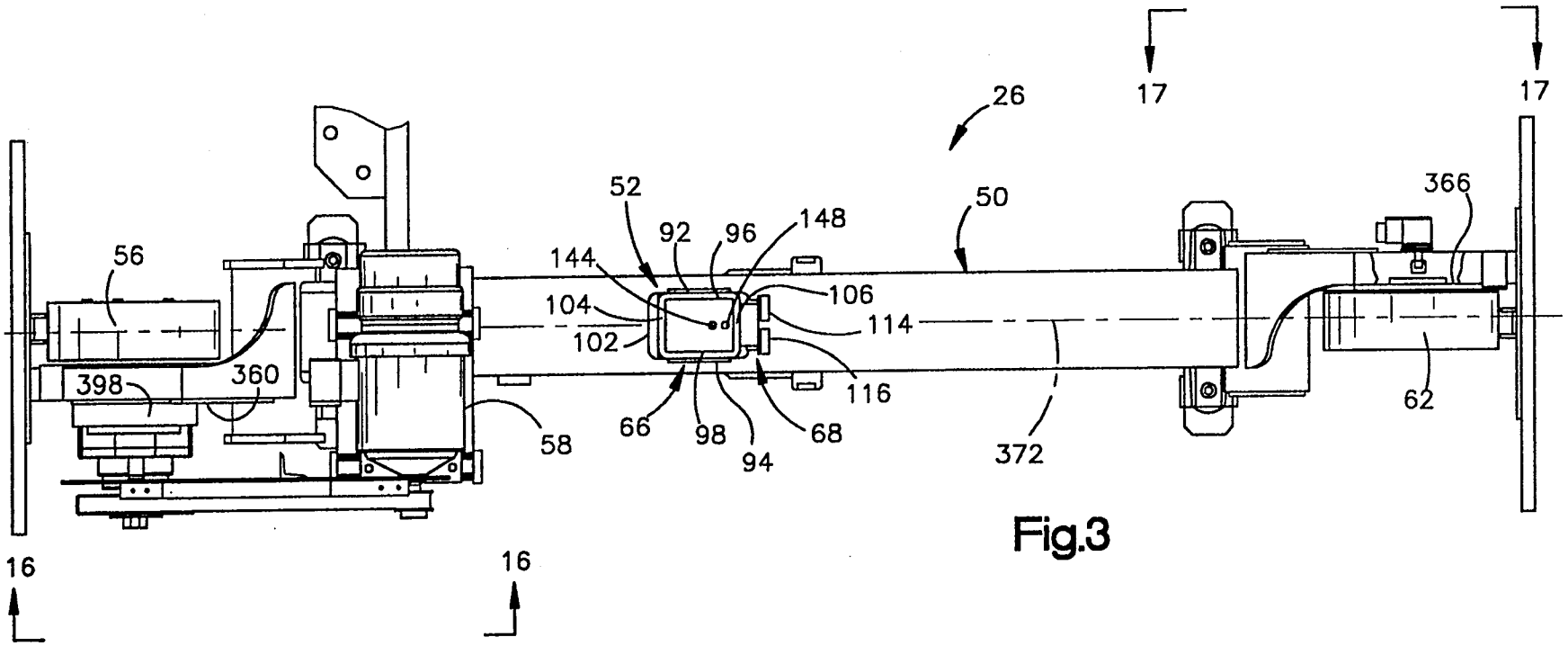
FIG. 3 is a plan view, taken generally along the line 3—3 of FIG. 2.

The base assembly 26 includes a horizontal main section or frame 50 and a vertical mast support section 52 (FIGS. 2 and 3). A drive wheel 56 is rotatably mounted on a rear end portion of the main section 50 of the base assembly 26. A drive assembly 58 is mounted on the main section 50 to rotate the drive wheel 56. An idler wheel 62 is rotatably mounted on a front end portion of the main section of the base assembly 26. The drive and idler wheels 56 and 62 engage the lower guide rail 24 (FIG. 1) to guide movement of the stacker assembly 20 along the lower guide rail.

In accordance with one of the features of the present invention, the mast support section 52 extends upwardly from the main section or frame 50 and is telescopically received in the hollow mast 28. The mast support section 52 includes a vertical support tube 66 and a gripper assembly 68. In accordance with another feature of the invention, the gripper assembly 68 is operable to expand the mast support section 52 to grip the inside of the lower end portion of the hollow mast 28.

Figure 5:
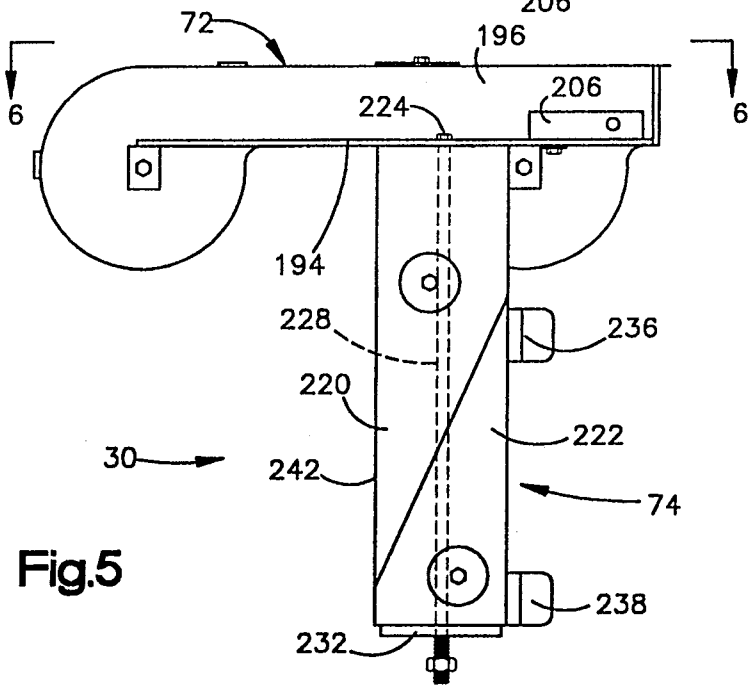
FIG. 5 is a side elevational view of a cap assembly disposed at the upper end portion of the stacker of FIG. 1.
Figure 7:
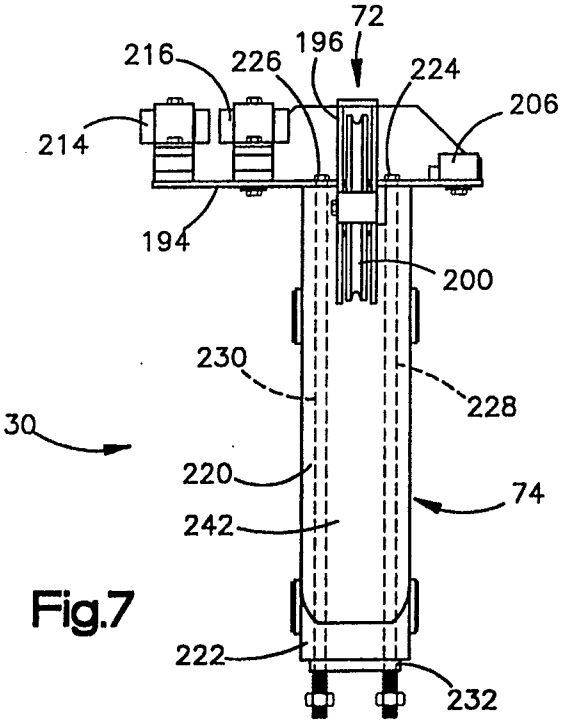
FIG. 7 is a rear elevational view, taken generally along the line 7—7 of FIG. 6.
Figure 8:
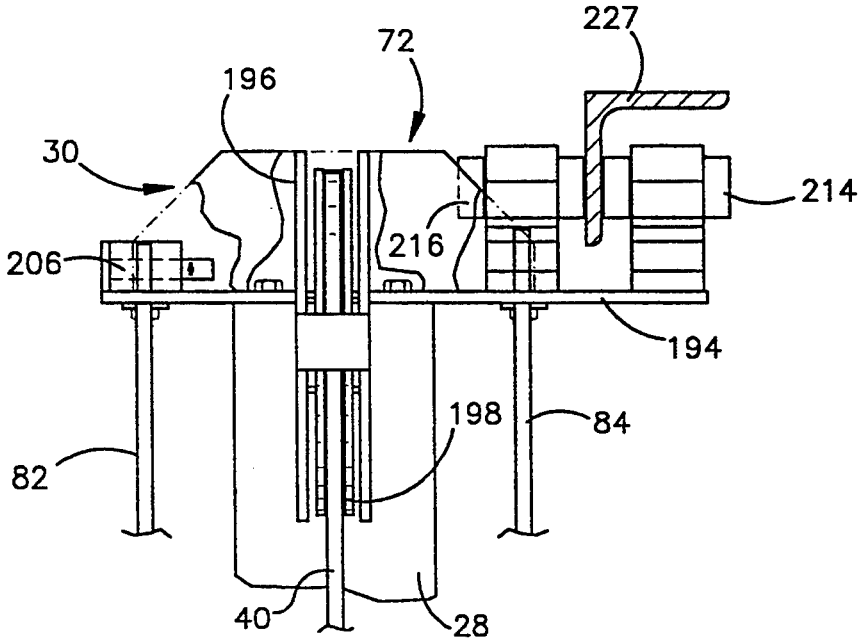
FIG. 8 is an enlarged fragmentary front elevational view, taken along the line 8—8 of FIG. 1, and illustrating the manner in which the cap assembly is disposed on the upper end portion of a hollow mast and the manner in which brake bars are suspended from the cap assembly.

The cap assembly 30 (FIGS. 5–7) includes a main section 72 which extends generally horizontally across the upper end portion of the mast 28 (FIGS. 1 and 8). In accordance with another feature of the present invention, a mounting section 74 (FIGS. 5 and 7) extends vertically downwardly from the main section 72 and is telescopically received in the upper end portion of the hollow mast 28. The mounting section 74 is expandable to grip the inside of the hollow mast 28.

Figure 11:
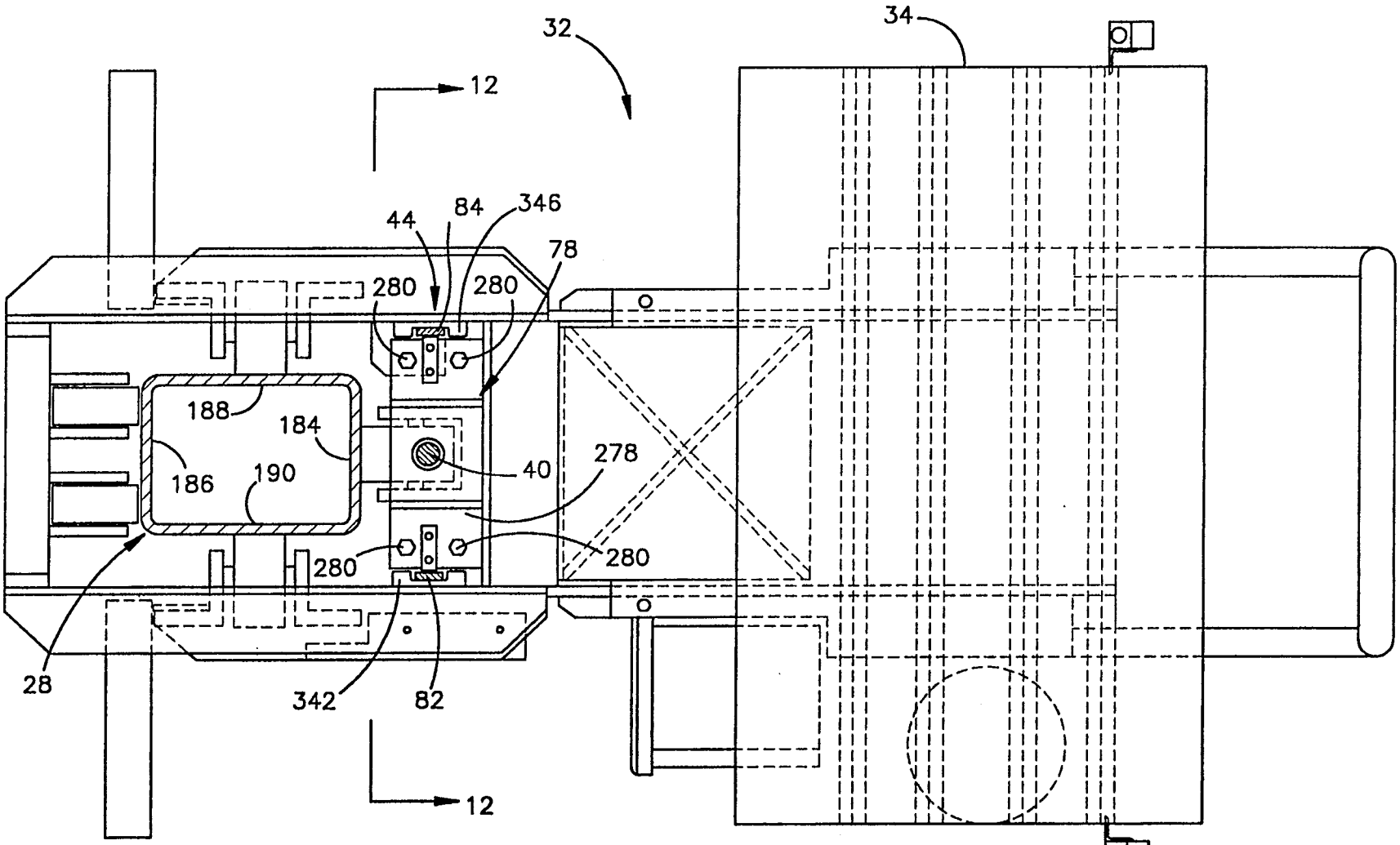
FIG. 11 is a sectional view, taken generally along the line 11—11 of FIG. 1, illustrating the manner in which the carriage is connected with the mast and illustrating the relationship between the carriage, mast and brake bars.

The brake system 44 includes a brake assembly 78 (FIGS. 11–14) mounted on the carriage 32 and a pair of elongated brake elements or bars 82 and 84 (FIGS. 1, 8 and 11). In accordance with another feature of the present invention, the brake bars 82 and 84 are suspended from the cap assembly 30 in a spaced apart relationship with the mast 28. The brake assembly 78 (FIG. 11) is disposed on the carriage between the two brake bars 82 and 84. The cable 40 extends through the center of the brake assembly 78.

Upon a loss of tension in the cable 40, the brake assembly 78 is operated to grip the brake bars 82 and 84. Force is transmitted through the brake bars 82 and 84 directly to the cap assembly 30 to support the carriage 32 against downward movement along the mast 28. Since the brake assembly 78 does not engage the mast 28 to prevent downward movement of the carriage 32, the mast can be made of materials which would not be suitable for engagement by the brake assembly.

In accordance with another of the features of the present invention, the drive and idler wheels 56 and 62 are mounted on accurately located surfaces on the main section or frame 50. This enables the drive and idler wheels 56 and 62 to be mounted on the main section or frame without complicated wheel alignment equipment and procedures.

Mast Support Section and Mast

The mast support section 52 includes the mast support tube 66 and the gripper assembly 68 (FIGS. 2 and 3). The mast support tube 66 is a hollow metal box beam having a lower end portion 90 (FIG. 2) which extends through the main section 50 of the base assembly 26. The lower end portion 90 of the support tube 66 is fixedly connected to the metal main section or frame 50. The mast support tube 66 extends vertically upwardly from the main section 50.

The mast support tube 66 is hollow and has a generally rectangular cross sectional configuration. Shims 92 and 94 (FIGS. 2 and 3) are disposed on opposite side walls 96 and 98 of the support tube 66. The shims 92 and 94 increase the width of the support tube 66 to a dimension which is only very slightly less than the width of the inside of the mast 28. A spacer 102 is mounted on a rear wall 104 of the support tube 66 and is engageable with an inner side surface of the rear wall of the mast 28. The gripper assembly 68 is mounted on the front wall 106 of the support tube 66 and is engageable with the inner side surface of a front wall of the mast 28.

It is contemplated that the support tube 66 could have many different dimensions depending upon the dimensions of the mast into which it is to be telescopically received. However, in one specific embodiment of the invention, the support tube 66 had a length of approximately 30 inches. The parallel side walls 96 and 98 (FIG. 3) were spaced apart by approximately four inches. Parallel rear and front walls 104 and 106 were perpendicular to the side walls 96 and 98 and were spaced apart by a distance of approximately four inches. In this one particular embodiment of the invention, the support tube 66 extended upwardly from the main section 50 of the base for a distance of approximately 25 inches. It should be understood that the foregoing specific dimensions for the support tube 66 have been set forth herein merely for purposes of clarity of description. It is contemplated that the support tube 66 could have many dimensions other than these specific dimensions.

The gripper assembly 68 is operable to expand the mast support section 52 to grip the inside of the mast 28. The gripper assembly 68 includes a lower set 110 (FIG. 2) of wedges which cooperate to expand the lower portion of the mast support section 52. An upper set 112 of wedges cooperate to expand the upper portion of the mast support section 52.

The upper and lower sets 110 and 112 of wedges are interconnected by connector strips 114 and 116 (FIGS. 2 and 3). The connector strips 114 and 116 extend parallel to each other and are spaced a slight distance apart to accommodate a bead on the inside of the mast 28. Depending upon the material from which the mast 28 is formed, the mast may be free of a bead on the inside of the mast so that it would not be necessary to provide space between the connector strips 114 and 116.

If the mast 28 is formed of relatively hard material, the connector strips 114 and 116 may have flat surfaces which are also formed of a relatively hard material. However, if the mast is formed of a polymeric material or of a relatively soft metal, the outer side surface of the connector strips 114 and 116 would be formed of a relatively soft material, such as a polymeric material.

Regardless of the material of which the connector strips 114 and 116 are formed, they are pressed in flat abutting engagement with the inner side surface of the front wall of the mast by the lower and upper sets 110 and 112 of wedges.

An outer wedge 120 (FIG. 2) in the lower set 110 of wedges and an outer wedge 122 in the upper set 112 of wedges have flat outer side surfaces fixedly connected to the connector strips 114 and 116. An inner wedge 124 in the lower set 110 of wedges is positioned adjacent to the main section 50 of the base assembly 26. The inner wedge 124 has a cam or wedging surface which is disposed in flat abutting engagement with a cam or wedging surface on the outer wedge 120 of the lower set of wedges 110. Similarly, an inner wedge 126 is disposed adjacent to the upper end portion of the support tube 66. The inner wedge 126 has a cam or wedging surface which is disposed in abutting engagement with a cam or wedging surface on the outer wedge 122.

The lower and upper sets 110 and 112 of wedges are sequentially actuated to first expand the lower end portion of the mast support section 52 and then to expand the upper end portion of the mast support section. A lower wedge actuator assembly 130 (FIGS. 2 and 4) is operable to effect actuation of the lower set of wedges 110. An upper wedge actuator assembly 132 is operable to effect actuation of the upper set 112 of wedges after the lower set 110 of wedges have been actuated.

Figure 4:
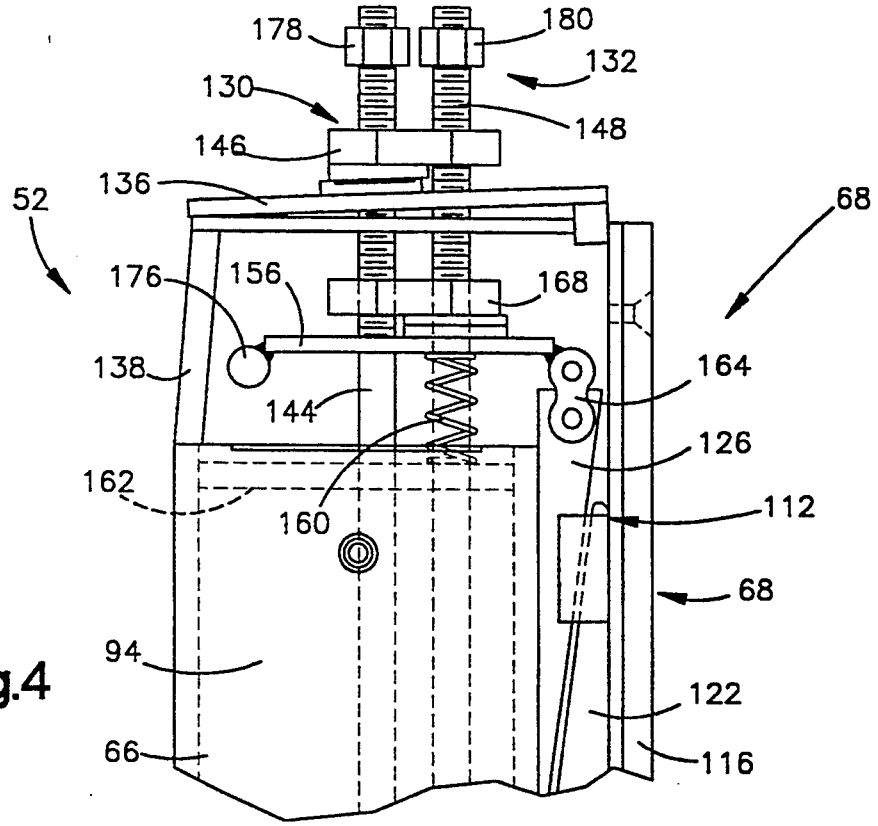
FIG. 4 is an enlarged side view of an upper end portion of the mast support assembly of FIG. 2 and illustrating the construction of a gripper actuator assembly.

The lower wedge actuator assembly 130 includes an upper rocker plate 136 (FIG. 4). A left (as viewed in FIG. 4) or rearward end portion of the upper rocker plate 136 is supported by an upper end of a stationary finger 138 which extends upwardly from the support tube 66. The opposite or right end portion of the upper rocker plate 136 is disposed in engagement with the upper end portions of the connector strips 114 and 116.

The upper rocker plate 136 is pivoted in a clockwise direction (as viewed in FIG. 4) about the finger 138 by a first or rearward actuator rod 144. The upper end portion of the actuator rod 144 is externally threaded and engages an internally threaded hole formed in a nut plate 146. The upper nut plate 146 is held against rotation by a second or forward actuator rod 148 which extends parallel to the first actuator rod 144. The forward actuator rod 148 extends through an untapped hole in the upper nut plate 146.

The rearward actuator rod 144 has a head end portion 152 (FIG. 10) which is accessible from beneath the base assembly 26. Upon rotation of the head end portion 152 of the rearward actuator rod 144, the nut plate 146 is moved downwardly (as viewed in FIG. 4). This causes the upper rocker plate 136 to pivot in a clockwise direction about the finger 138. Clockwise rotation of the upper rocker plate 136 moves the connector strips 114 and 116 downwardly (as viewed in FIGS. 2 and 4). Downward movement of the connector strips 114 and 116 moves the outer wedge 122 of the upper set 112 of wedges downwardly (as viewed in FIG. 4). This results in a loosening of the upper set 112 of wedges.

In addition, downward movement of the connector strips 114 and 116 moves the outer wedge 120 (FIG. 2) of the lower set 110 of wedges downwardly relative to the stationary inner wedge 124 of the lower set of wedges. As the outer wedge 120 is moved downwardly, the inner wedge 124 cams or forces the outer wedge 120 forwardly or toward the right (as viewed in FIG. 2). This expands the lower end portion of the mast support section 52 to press the lower end portions of the connector strips 114 and 116 against the inner side surface of the front wall of the mast 28.

Once the lower end portion of the mast support section 52 has been expanded by the lower set 110 of wedges to grip the lower end portion of the mast 28, the upper set 112 of wedges is actuated to expand the upper end portion of the mast support section 52 to grip the inside of the mast. To operate the gripper assembly 68 to expand the upper end portion of the mast support section 52, the upper wedge actuator assembly 132 is operated.

The upper wedge actuator assembly 132 includes a lower rocker plate 156 (FIG. 4) which is moved downwardly to move the inner wedge 126 in the upper set 112 of wedges downwardly. The upper rocker plate 156 is urged upwardly by a coil spring 160 which extends around the actuator rod 148 and is disposed between the lower rocker plate 156 and a panel 162 which closes the upper end of the support tube 66. The right (as viewed in FIG. 4) end portion of the upper rocker plate 156 is connected with the inner wedge 126 by a chain link 164. Thus, the upper rocker plate 156 is pivotally connected with an upper portion of the chain link 164 and the inner wedge 126 is pivotally connected with a lower portion of the chain link. The spring 160 urges the lower rocker plate 156 upwardly to pull the inner wedge 126 upwardly so that the upper set 112 of wedges remains in a disengaged condition until the upper wedge actuator assembly 132 is operated.

A lower nut plate 168 has an internally threaded hole or opening which engages the externally threaded upper end portion of the forward actuator rod 148. The rearward actuator rod 144 extends through an untapped hole in the nut plate 168 to hold the nut plate against rotation. A head end portion 172 (FIG. 10) of the forward actuator rod 148 is accessible from beneath the main section 50 of the base assembly 26.

Rotation of the head end 172 (FIG. 10) of the forward actuator rod 148 causes the nut plate 168 (FIG. 4) to move downwardly. As this occurs, the inner wedge 126 is pressed downwardly against the outer wedge 122 (FIG. 4) by the link 164. When the interaction between the wedges 122 and 126 is effective to resist downward movement of the rocker plate 156, continued rotation of the forward actuator rod 148 causes the rocker plate 156 to pivot in a counterclockwise direction about the chain link 164. As this occurs, a rod 176 connected with the left (as viewed in FIG. 4) end portion of the lower rocker plate 156 moves downwardly into engagement with the panel 162.

Continued rotation of the forward actuator rod 148 moves the nut plate 168 downwardly and pivots the lower rocker plate 156 about the short rod 176 to force the inner wedge 126 downwardly against the outer wedge 122. This cams the connector strips 114 and 116 outwardly at the upper end portion of the mast support section 52. As the upper end portion of the mast support section 52 is expanded, the connector strips 114 and 116 are pressed against the inner side surface of the front wall of the mast 28 to firmly grip the mast.

A pair of retainer nuts 178 and 180 (FIG. 4) are fixedly connected to the upper end portions of the actuator rods 144 and 148. The retainer nuts 178 and 180 prevent the nut plate 146 and other components of the upper and lower wedge actuator assemblies 130 and 132 from becoming disengaged from the actuator rods 144 and 148. The actuator rods 144 and 148 have longitudinally extending central axes which are parallel to the longitudinal central axis of the mast 28 and of the support tube 66. The head ends 152 and 172 (FIG. 10) of the actuator rods 144 and 148 are accessible from the lower side of the main section 50 of the base assembly 26 when the mast 28 is telescoped over the mast support section 52. Therefore, the actuator rods 144 and 148 can be readily rotated with a suitable wrench or other tool to cause the gripper assembly 68 to grip the lower end portion of the mast once the mast has been telescoped over the mast support section 52.

The mast 28 is a hollow tubular member having a rectangular cross sectional configuration (FIGS. 1, 3 and 11). The mast 28 can be formed of almost any desired material, such as metal, polymeric materials or fiber reinforced composite materials. By forming the mast 28 of polymeric materials or fiber reinforced composite materials, the weight of the mast 28 can be minimized while maintaining the strength of the mast. The base assembly 26 and cap assembly 30 are formed of metal, that is, steel.

The mast 28 has a rectangular cross section which is slightly greater than the rectangular cross section of the mast support tube 66. When the mast 28 is telescoped around the mast support section 52, a front side wall 184 (FIG. 11) of the mast is adjacent to the front side wall 106 (FIG. 3) of the mast support tube 66 and the gripper assembly 68. Similarly, a rear side wall 186 of the mast 28 is adjacent to the rear side wall 104 of the support tube 66 and the spacer 102. The opposite side walls 188 and 190 (FIG. 11) of the mast 28 are disposed adjacent to the side walls 96 and 98 (FIG. 3) of the support tube 66 and the shims 92 and 94. The shims 92 and 94 provide a very close clearance between the side surfaces of the side walls 188 and 190 of the mast 28 and the mast support section 52. When the gripper assembly 68 is expanded, the front wall 184 and the rear wall 186 of the mast are pressed firmly against the spacer 102 on the rear wall 104 of the support tube 66 (FIG. 3) and against the connector strips 114 and 116 adjacent to the front wall 106 of the support tube 66.

In one specific embodiment of the invention, the mast 28 was formed of fiberglass and had a height of approximately 19 feet. The parallel side walls 188 and 190 (FIG. 11) of the mast had a width of approximately 7 inches. Parallel front and rear walls 184 and 186, which extend perpendicular to the side walls 188 and 190, had a width of approximately 5 inches. It should be understood that the foregoing specific dimensions and the material for the mast 28 have been set forth herein merely for purposes of clarity of description and it is contemplated that the mast 28 may be formed of different materials and may have different dimensions.

Cap Assembly

The cap assembly 30 (FIGS. 5–7) is disposed at the upper end of the mast 28 (FIG. 1). The cap assembly 30 (FIG. 1) guides the cable 40 which extends from the drum 38 around the cap assembly to the carriage 32. The cap assembly 30 also supports the brake bars 82 and 84 (FIG. 8). In addition, the cap assembly 30 engages the upper guide rail 22 (FIGS. 1 and 8) to stabilize the mast 28.

The main section 72 (FIGS. 5–7) of the cap assembly 30 includes a metal upper support plate 194 and a metal center wall 196. A front sheave 198 (FIG. 6) and a rear sheave 200 are rotatable relative to the center wall 196. The cable 40 (FIG. 1) extends upwardly from the drum 38 part way around the rear sheave 200 (FIG. 6) to the front sheave 198. The cable extends downwardly from the front sheave 198 to the carriage 32.

Figure 6:
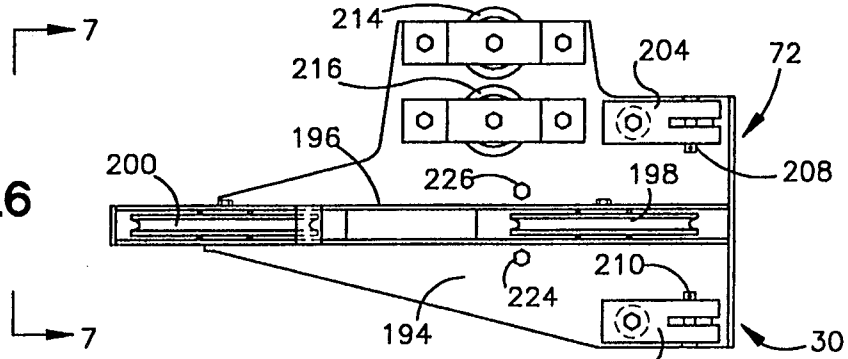
FIG. 6 is a plan view, taken generally along the line 6—6 of FIG. 5.

Brake bar hangers 204 and 206 (FIG. 6) are disposed on the support plate 194 on opposite sides of the center wall 196. The brake bar hangers 204 and 206 include support pins 208 and 210 which extend through the brake bars 82 and 84 (FIG. 8) to pivotally suspend the brake bars from the cap assembly 30. A pair of guide rollers 214 and 216 are rotatably mounted on the support plate 194 (FIGS. 6 and 7). The guide rollers 214 and 216 engage opposite sides of the upper guide rail 22 (FIG. 8) to stabilize the mast 28.

The cap assembly 30 includes the metal mounting section 74 (FIGS. 5 and 7) which extends downwardly from the main section 72 and is telescopically received in the upper end portion of the mast 28. The mounting section 74 is expandable to grip the inside of the hollow mast 28 to securely connect the cap assembly 30 with the hollow mast.

The mounting section 74 includes a base wedge section 220 which is fixedly connected to the main section 72. A movable wedge section 222 is disposed in abutting engagement with the base wedge section 220. Head ends 224 and 226 of actuator rods 228 and 230 are disposed in abutting engagement with the support plate 194. Threaded lower end portions of the actuator rods 228 and 230 are received in tapped openings formed in a nut plate 232.

After the mounting section 74 has been telescopically inserted into the upper end portion of the mast 28, the head ends 224 and 226 of the actuator rods 228 and 230 are rotated. Rotation of the actuator rods 228 and 230 pulls the nut plate 232 upwardly (as viewed in FIGS. 5 and 7) toward the support plate 194. As this occurs, cam or wedge surfaces between the base wedge section 220 and the movable wedge section 222 cam or force the movable wedge section 222 forwardly or toward the right (as viewed in FIG. 5). This presses spacers 236 and 238 (FIG. 5) on the movable wedge section 222 against the inner side surface of the front wall 184 (FIG. 11) of the mast 28. In addition, a rear side surface 242 (FIGS. 5 and 7) of the base wedge section 220 is pressed in flat abutting engagement against the inner side surface of the rear wall 186 (FIG. 11) of the mast 28. This results in the mounting section 74 firmly gripping the inside of the mast 28 to hold the cap assembly in position on the mast.

Brake System

The brake system 44 retains the carriage 32 against downward movement along the mast 28 in the unlikely event of a loss of tension in the cable 40. The brake system 44 includes a brake assembly 78 (FIG. 11) which is mounted on the carriage 32 and the brake bars or elongated elements 82 and 84 which are suspended from the cap assembly 30. Upon the loss of tension in the cable 40, the brake assembly 78 on the carriage 32 firmly grips the brake bars 82 and 84 to hold the carriage against downward movement along the mast 28.

Figure 9:
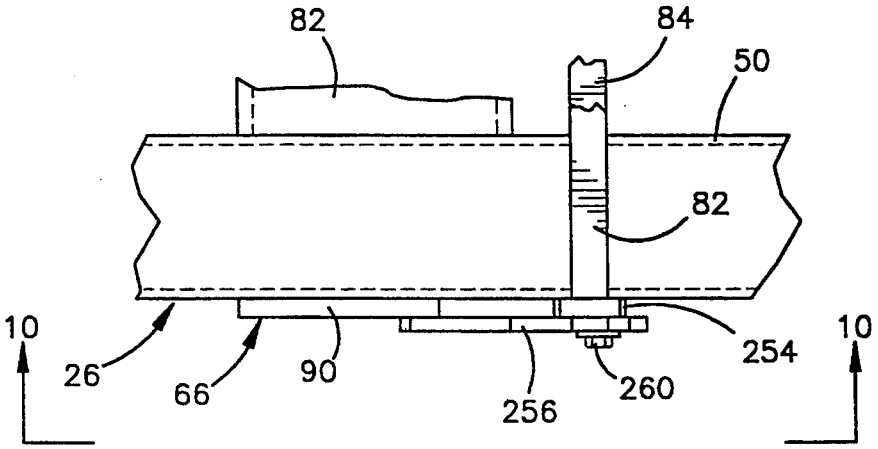
FIG. 9 is an enlarged fragmentary view of a portion of FIG. 1 and illustrating the manner in which a lower end of a brake bar is restrained by the base assembly.
Figure 10:
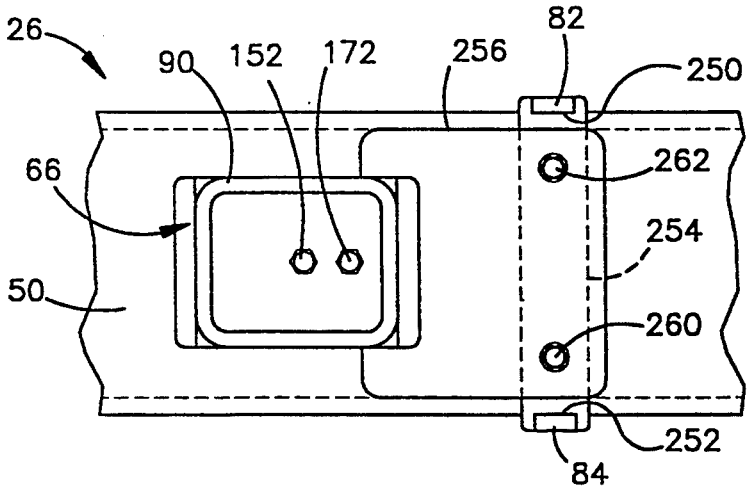
FIG. 10 is a view, looking up, from underneath the base assembly and taken generally along the line 10—10 of FIG. 9.

The upper ends of the metal brake bars 82 and 84 are pivotally suspended on the pins 208 and 210 (FIG. 6) of the brake bar hangers 204 and 206 on the cap assembly 30. The brake bars 82 and 84 (FIG. 8) hang straight downwardly from the cap assembly 30 through passages in the carriage 32 to the base assembly 26 (FIGS. 1, 9 and 10). The lower ends of the brake bars 82 and 84 are received in recesses 250 and 252 (FIG. 10) formed in a brake bar retainer plate 254. The brake bar retainer plate 254 is held in position by a retainer plate 256 and bolts 260 and 262 (FIGS. 9 and 10) which engage the main section 50 of the base assembly 26. The lower ends of the brake bars 82 and 84 are held in the recesses 250 and 252 by suitable caps or closures which extend across the open sidewardly facing end portions of the recesses.

During construction of the stacker assembly 20, the brake bars 82 and 84 are suspended from the cap assembly after the carriage 32 has been mounted on the mast 28. The carriage 32 is then moved downwardly along the mast to its lowermost position in order to locate the lower ends of the brake bars 82 and 84 relative to the retainer plate 254. Retainer plate 254 is then positioned relative to the main section 50 of the base assembly 26 and the bolts 260 and 262 are tightened to accurately position the lower ends of the brake bars 82 and 84 relative to the base assembly. Since the brake bars 82 and 84 are positioned relative to the base assembly 26 by the carriage 32, the brake bars are accurately located so that they do not interfere with movement of the carriage 32 along the base.

The brake assembly 78 (FIGS. 11, 12, 13 and 14) is mounted on the carriage 32 between the brake bars 82 and 84. The cable 40 is connected with the carriage 32 at the center portion of the brake assembly 78. Thus, upward force is transmitted to the carriage 32 from the cable 40 through the brake assembly 78.

The brake assembly 78 is mounted on the carriage 32 forwardly of the mast 28 (FIG. 11). The brake bars 82 and 84 are located forwardly of and offset sidewardly from the mast 28. Thus, the brake assembly 78 and brake bars 82 and 84 are not connected to the mast 28. The brake bars 82 and 84 are connected to the cap assembly 30 at the hangers 204 and 206 and are connected with the base assembly 26 at the brake bar retainer plate 254.

Since the brake system 44 is spaced apart from the mast 28, force is not transmitted directly from the brake system to the mast. Thus, when the brake system 44 is engaged so that the carriage 32 is supported by the brake bars 82 and 84, tensile forces are transmitted from the carriage 32 through the brake bars 82 and 84 to the cap assembly 30. The cap assembly 30 applies a downward compression force against the upper end of the mast 28. This compression force is transmitted through the mast 28 to the base assembly 26.

The brake bars 82 and 84 are free of connections with the mast 28 along the length of the brake bars between the base assembly 26 and carriage 32. The brake bars 82 and 84 are also free of connections with the mast 28 along the length of the brake bars between the carriage 32 and cap assembly 30. Therefore, the brake bars 82 and 84 can extend through passages in the carriage 32 without interfering with movement of the carriage along the mast 28.

The brake assembly 78 (FIGS. 12–14) includes a pair of metal brake members 270 and 272 which are pivotally mounted between support blocks 274 and 276. A cover plate 278 (FIGS. 11 and 12) is fixedly connected across the upper end portions of the support blocks 274 and 276 by bolts 280. The cover plate 278 is fixedly secured to the carriage 32.

Figure 14:
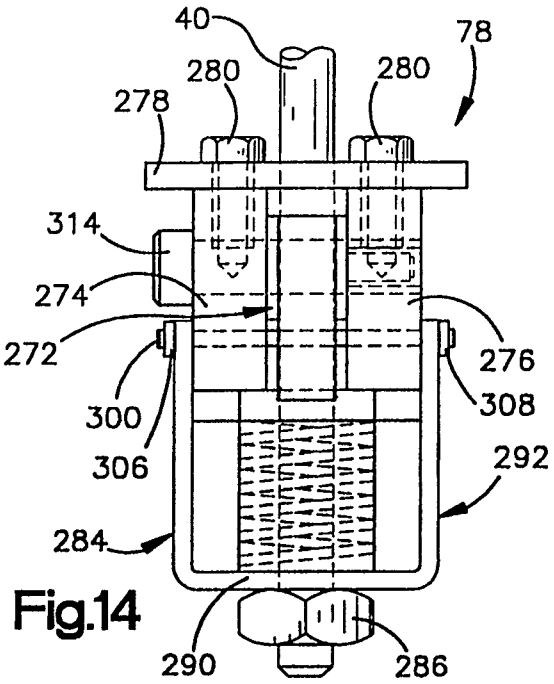
FIG. 14 is a side elevational view, taken generally along the line 14—14 of FIG. 12.
Figure 13:
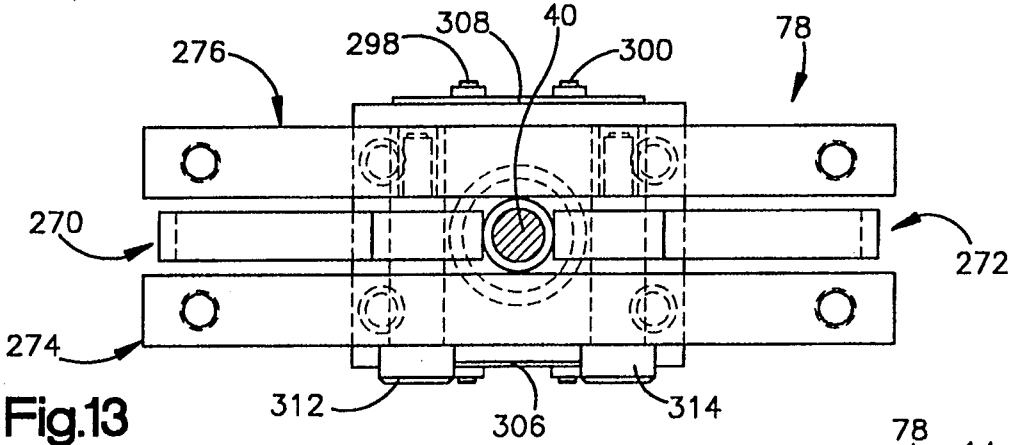
FIG. 13 is a plan view, taken generally along the line 13—13 of FIG. 12.
Figure 12:
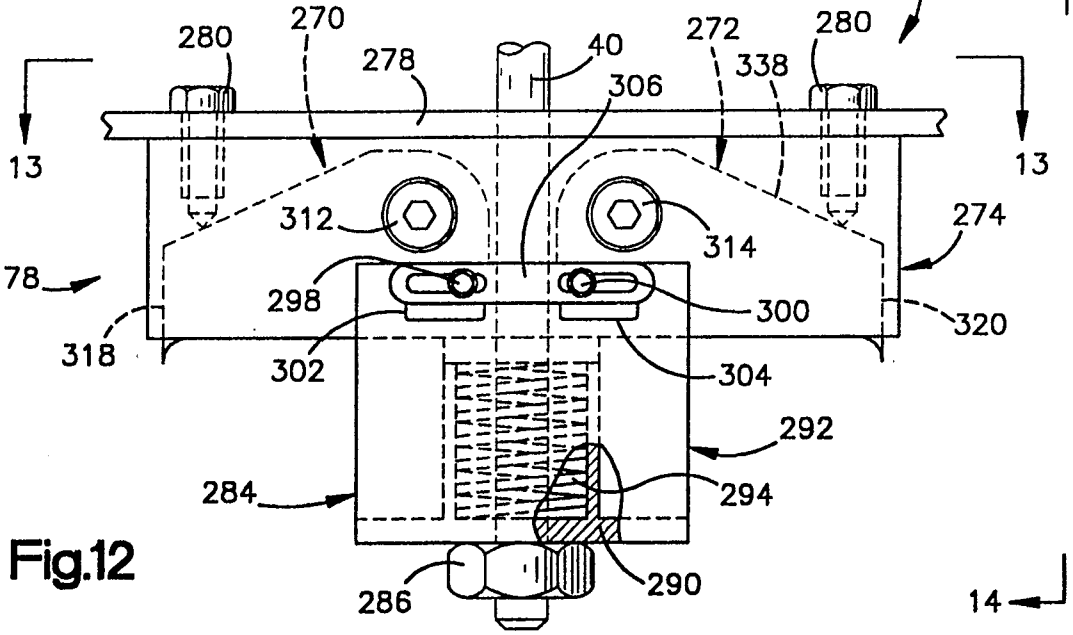
FIG. 12 is an elevational view, taken generally along the line 12—12 of FIG. 11, illustrating the construction of a brake assembly disposed on the carriage and engageable with the brake bars.

The cable 40 extends downwardly between the brake members 270 and 272 to a bracket assembly 284 (FIGS. 12 and 14). A retainer 286 is swaged onto the lower end of the cable 284 and applies upward force against a lower side wall 290 of a generally U-shaped bracket 292. A coil spring 294 is compressed between the side wall 290 of the bracket 292 and the support blocks 274 and 276.

A pair of pins 298 and 300 (FIG. 12) extend through openings 302 and 304 formed in the bracket 292 and through the brake members 270 and 272. Retainer bars 306 and 308 (FIGS. 12 and 13) extend between the pins 298 and 300 to interconnect the pins and cause the two brake members 270 and 272 to actuate simultaneously.

The force applied to the bracket 292 by the retainer 286 compresses the spring 294 against the support blocks 274 and 276. This causes the pins 298 and 300 to be forced upwardly to the position shown in FIG. 12. Forcing the pins 298 and 300 upwardly to the position shown in FIG. 12 tends to pivot the brake member 270 in a counterclockwise direction and to pivot the brake member 272 in a clockwise direction (as viewed in FIG. 12). Therefore, the brake members 270 and 272 are retained in the retracted position shown in FIG. 12.

In the unlikely event of a loss of tension in the cable 40 due to breaking of the cable or other causes, the force applied by the retainer 286 on the end of the cable 40 to the bracket 292 is eliminated. This results in the coil spring 294 being extended downwardly (as viewed in FIG. 12). As the coil spring 294 is extended downwardly, the bracket 292 pulls the pins 298 and 300 downwardly to pivot the brake member 270 in a clockwise direction about a support member 312 and to pivot the brake member 272 in a counterclockwise direction about a support member 314.

As the brake members 270 and 272 pivot relative to the support blocks 274 and 276, toothed outer end portions 318 and 320 (FIG. 12) of the metal brake members 270 and 272 are swung out from between the support blocks 274 and 276 and into engagement with parallel vertical side surfaces on the brake bars 82 and 84. The brake members 270 and 272 then move into gouging frictional engagement with the brake bars 82 and 84 to immediately stop downward movement of the carriage 32. When the carriage 32 applies a very large downward force to the brake members 270 and 272, the brake members move into abutting engagement with the cover plate 278. This stops the pivoting movement of the brake members 270 and 272 about the support members 312 and 314.

The brake members 270 and 272 engage the brake bars 82 and 84 to hold the carriage 32 against downward movement along the mast 28. The force required to support carriage 32 and a load on the shuttle 34 is transmitted from the brake bars 82 and 84 directly to the cap assembly 30. Thus, the force required to support the carriage 32 is transmitted through the brake bars 82 and 84 to the cap assembly 30 and is transmitted from the cap assembly to the mast 28.

Figure 15:
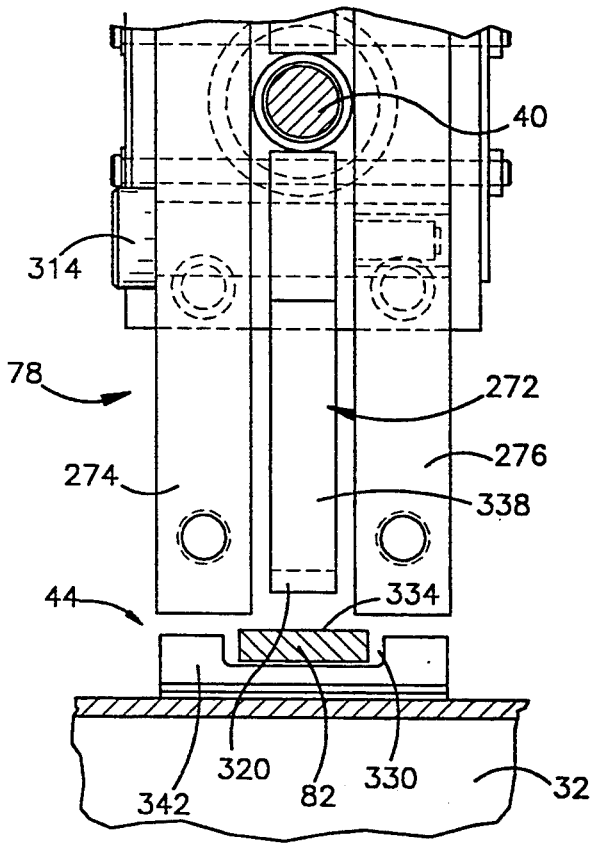
FIG. 15 (on sheet 4 of the drawings) is an enlarged fragmentary illustration depicting the relationship of a portion of the brake assembly of FIGS. 12–14 to a brake bar.

The relationship between the brake bar 82, the brake assembly 78 and the carriage 32 is further illustrated in FIG. 15. The brake bar 82 extends through a passage 330 formed in the carriage 32. The brake assembly 78 is disposed midway between the brake bars 82 and 84. When the brake assembly 78 is in its normal disengaged condition and tension in the cable 40 compresses the spring 294 (FIG. 12) to hold the brake members 270 and 272 in their retracted positions, the carriage 32 is freely movable relative to brake bars 82 and 84. Thus, the passage 330 (FIG. 15) through which the brake bar 82 extends is large enough to prevent binding or interference between the brake bar 82 and the carriage 32.

Upon the occurrence of a loss of tension in the cable 40, the U-shaped bracket 292 moves downwardly (as viewed in FIG. 12) and pivots the brake member 272 in a counterclockwise direction about the support member 314. This causes the end portion 320 of the brake member 272 to move outwardly into engagement with a flat side surface 334 (FIG. 15) on the brake bar 82. Engagement of the toothed end portion 320 of the brake member 272 with the brake bar 84 causes the brake member to pivot further in the counterclockwise direction (as viewed in FIG. 12). At this time, the brake bar 82 is pressed outwardly against a backing member 342 (FIG. 15) on the carriage 32. The backing member 342 cooperates with the brake member 272 and brake bar 82 to lock the carriage 32 against downward movement. Thus, the brake bar 82 is securely gripped between the backing member 342 and brake member 272.

Although only the relationship between the brake member 272, the brake bar 82 and a backing member 342 has been shown in FIG. 15, it should be understood that the brake member 270, brake bar 84 and a backing member cooperate in the same manner as in which the brake member 272 and backing member 342 cooperate with the brake bar 82. Thus, the brake bar 84 (FIG. 11) extends through a passage, corresponding to the passage 330 for the brake bar 82, in the carriage 32 and is engaged by the brake member 270 upon a loss of tension in the cable 40. A backing member 346 (FIG. 11) cooperates with the brake member 270 to grip the brake bar 84 when the brake member is in an engaged position.

In the illustrated embodiment of the invention, the brake bars 82 and 84 have rectangular cross sectional configurations and are formed by longitudinally extending bars of metal. It is contemplated that the brake bars 82 and 84 could have a different configuration and/or construction. Thus, cables could be suspended from the cap assembly 30 to the base assembly 26 and be engaged by a brake assembly to support the carriage 32 in the same manner as in which the brake bars 82 and 84 are used to support the carriage. Of course, if cables were used as the elongated brake elements 82 and 84 extending between the cap assembly 30 and the base assembly 26, the brake assembly 78 would have brake members with a configuration which would enable them to engage the generally cylindrical cables.

It is preferred to have the brake bars 82 and 84 suspended from the cap assembly 30 and spaced from the mast 28. This mounting arrangement for the brake bars 82 and 84 is particularly advantageous when the mast 28 is formed of fiberglass, aluminum or composite materials. However, it may be desired to connect the brake bars 82 and 84 to the mast along the length of the brake bars, that is, at locations between the cap assembly 30 and base assembly 28.

Wheel Mounting Arrangement

Figure 16:
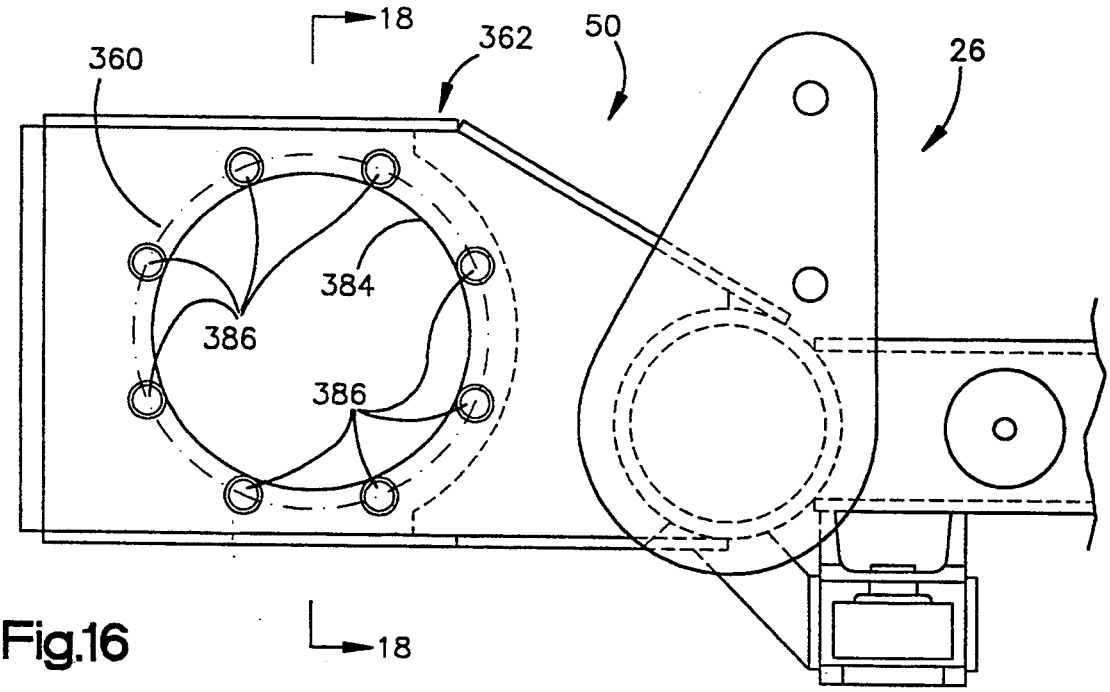
FIG. 16 is a fragmentary side elevational view, taken generally along the line 16—16 of FIG. 3, illustrating a rear end portion of the base assembly with components of the stacker removed for purposes of clarity of illustration.
Figure 17:
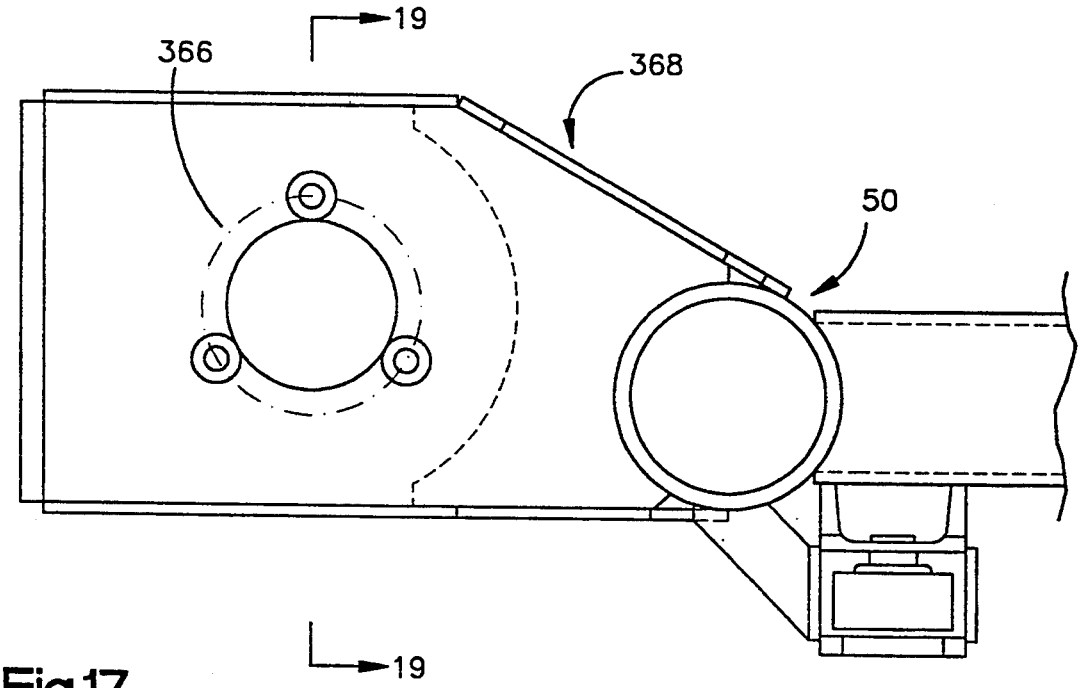
FIG. 17 is a fragmentary side elevational view, taken generally along the line 17—17 of FIG. 3, of a forward end portion of the base assembly, with components of the stacker removed for purposes of clarity of illustration.

In accordance with one of the features of the invention, the drive wheel 56 and idler wheel 62 are connected with accurately located mounting surfaces on the main section or frame 50 of the base assembly 26. Thus, an annular rear mounting surface area 360 (FIG. 16) is accurately formed on a rear end portion 362 of the frame or main section 50. Similarly, an annular front mounting surface area 366 is accurately formed on a front end portion 368 of the main section or frame 50.

The two mounting surfaces 360 and 366 are flat and are disposed in parallel vertical planes (FIG. 3). The flat parallel mounting surfaces 360 and 366 are accurately machined on the main section or frame 50 so as to be exactly parallel to each other and to a longitudinal central axis 372 (FIG. 3) of the main section or frame. The accurately formed mounting surfaces 360 and 366 are disposed on opposite sides of the longitudinal central axis 372 of the main section or frame 50 and face away from the longitudinal central axis. The longitudinal central axis 372 extends through the wheels 56 and 62 and is perpendicular to parallel axes about which the wheels 56 and 62 rotate. The mounting surfaces 360 and 366 are disposed in parallel vertical planes with the longitudinal central axis 372 extending between and parallel to the planes containing the mounting surfaces.

Figure 18:
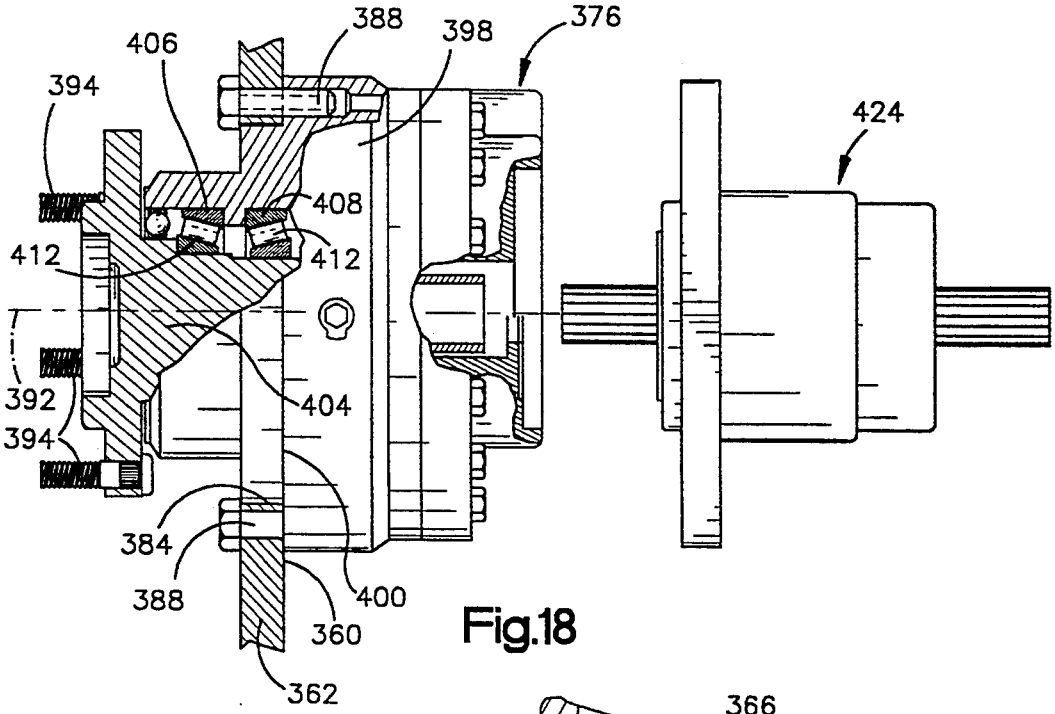
FIG. 18 is a sectional view, taken generally along the line 18—18 of FIG. 16, illustrating the manner in which a mounting assembly is connected with the rear end portion of the base assembly.
Figure 19:
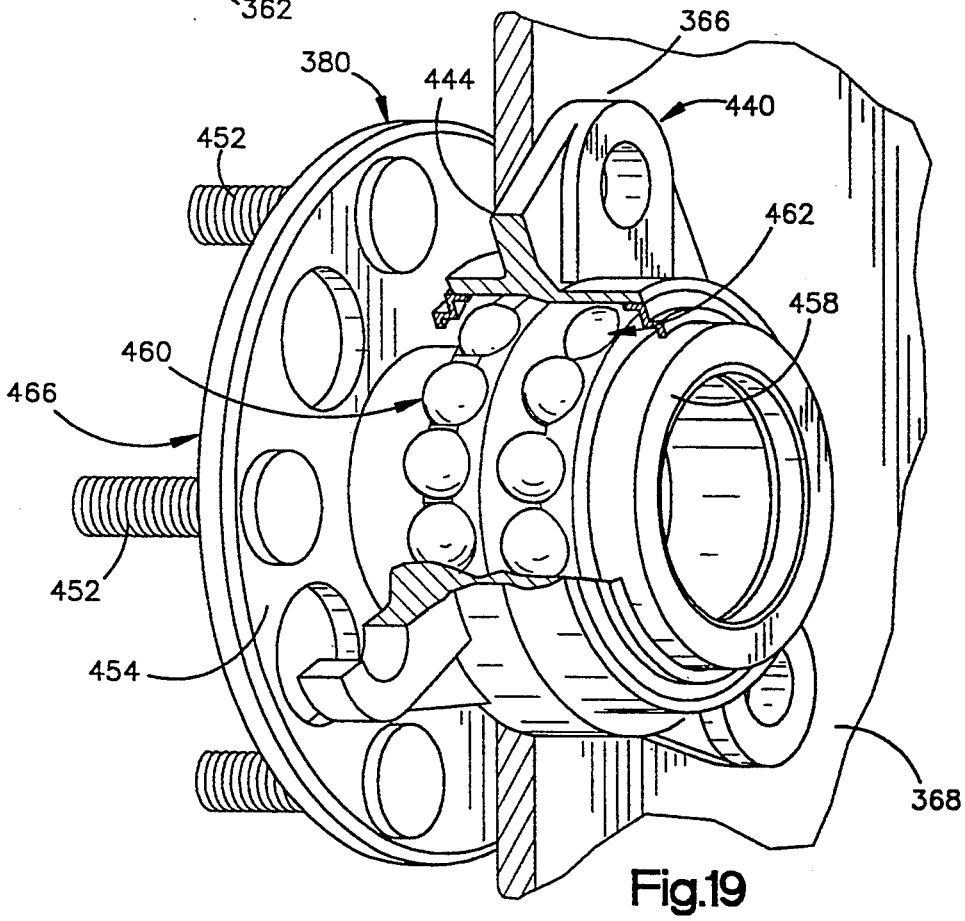
FIG. 19 is a pictorial sectional view, taken generally along the line 19—19 of FIG. 17, illustrating the manner in which a wheel mounting assembly is connected with the forward end portion of the base assembly.

By accurately forming the mounting surfaces 360 and 366 on the main section or frame 50, the drive wheel 56 and idler wheel 62 can be mounted directly on the main section or frame 50 without adjustment. Thus, a mounting assembly 376 (FIG. 18) is disposed in abutting engagement with the mounting surface 360 to mount the rear or drive wheel 56 on the main section or frame 50 of the base assembly 26. Similarly, wheel mounting assembly 380 is connected with the front section 368 to mount the front or idler wheel 62 on the front section (FIG. 19).

The mounting surface 360 is formed with a relatively large circular opening 384 (FIGS. 16 and 18) through which the mounting assembly 376 extends. A plurality of holes or openings 386 (FIG. 16) are disposed in a circular array around the central opening 384 to receive bolts 388 (FIG. 18). The bolts 388 fixedly secure the mounting assembly 376 to the rear end portion 362 of the main section or frame 50.

The mounting assembly 376 (FIG. 18) has a horizontal central axis 392 which extends perpendicular to the mounting surface 360 and to the longitudinal central axis 372 (FIG. 3) of the main section or frame 50. The drive wheel 56 is fixedly secured to the mounting assembly by bolts 394 (FIG. 18). The bolts 394 have horizontal central axes which extend parallel to the horizontal central axis 92 of the mounting assembly 376 and perpendicular to the mounting surface 360. Bolts 394 are connected with the drive wheel 56 to enable the mounting assembly 376 to support the drive wheel for rotation about the horizontal central axis 392 of the mounting assembly.

The mounting assembly 376 includes a one-piece support section 398. The one-piece support section 398 has a flat annular side surface 400 (FIG. 18) which is disposed in abutting engagement with the mounting surface 360. Since the vertical mounting surface 360 is accurately formed, the mounting surface 360 accurately locates the one-piece support section 398 with its central axis 392 horizontal and perpendicular to the vertical mounting surface 360. The vertical mounting surface 360 faces away from the longitudinal central axis 372 of the main section or frame 50 (FIG. 3). The one-piece support section 398 (FIG. 18) extends through the opening 384 toward the longitudinal central axis 372 of the main section or frame 50. Since the mounting surface 360 is accurately formed on the main section or frame 50, the mounting assembly 376 is accurately positioned relative to the base section or frame 50.

A one-piece wheel mounting section 404 (FIG. 18) is rotatably supported on the support section 398 by a pair of bearing assemblies 406 and 408. The bearing assemblies 406 and 408 support the wheel mounting section 404 in a telescopic relationship with the support section 398. Thus, the bearing assemblies 406 and 408 are disposed with in the support section 398 and the wheel mounting section 404 is telescoped into and is coaxial with the support section 398.

The bearing assemblies 406 and 408 include a plurality of rotatable bearing elements which are disposed in a pair of annular arrays which extend around the wheel support section 404. Although the bearing elements 412 are, in the illustrated embodiment of the invention rollers, it is contemplated that spherical or other shaped bearing elements could be used if desired.

The drive assembly 58 (FIG. 2) includes a motor 416 which is connected with the mounting assembly 376 through a toothed belt drive 418. An input shaft assembly 424 (FIG. 18) transmits force from the belt drive 418 (FIG. 2) to the mounting assembly 376. In the illustrated embodiment of the invention, the mounting assembly 376 includes a gear reduction unit. In the illustrated embodiment of the invention, the mounting assembly 376 is a "Torque-hub" (trademark) spindle drive which is commercially available from Fairfield Manufacturing Company, Inc. of Lafayette, Ind. with the designation S1E1433S6. The input shaft assembly 424 is commercially available from Rockford Manufacturing Group, Inc. of Roscoe, Ill.

The idler wheel 62 (FIG. 3) is mounted on the main section or frame 50 by the mounting assembly 380 (FIG. 19) in much the same manner as in which the drive wheel 56 is mounted on the main section or frame. The mounting assembly 380 for the idler wheel 62 includes a support section 440 which is fixedly secured to the main section or frame 50 by suitable bolts (not shown). The support section 440 has a flat side surface 444 which is disposed in flat abutting engagement with the vertical mounting surface 368. This results in a horizontal central axis of the mounting assembly 380 extending perpendicular to the flat vertical side surface 368 and to the longitudinal central axis 372 (FIG. 3) of the main section or frame 50. The horizontal central axis of the mounting assembly 380 extends parallel to the horizontal central axis of the mounting assembly 376. The mounting surface 368 faces away from the central axis 372 of the main section or frame 50 in the opposite direction from the mounting surface 360 (FIG. 18).

The mounting assembly 380 (FIG. 19) includes a one-piece wheel mounting section 448 which is disposed in a telescopic relationship with the one-piece support section 440. A plurality of wheel mounting bolts 452 extend outwardly from a circular flange 454 on the wheel mounting section 448. The bolts 452 have longitudinal central axes which extend parallel to the longitudinal central axis of the support section 440 and perpendicular to the mounting surface 368. The idler wheel is connected with the wheel mounting section 448 with a central axis of the idler wheel coincident with the central axes of the support section 440 and the wheel mounting section 448.

The wheel mounting section 448 includes a cylindrical section 458 which is telescopically received in the support section 440. A pair of bearing assemblies 460 and 462 support the wheel mounting section 448 for rotation relative to the support section 440. The mounting assembly 380 is commercially available from NDH Bearings of Sandusky, Ohio under part No. 513016K. Of course, other known types of bearing assemblies could be used if desired.

Conclusion

In view of the foregoing description, it is apparent that the present invention relates to a new and improved stacker 20 having a hollow mast 28 which extends upwardly from a base assembly 26. A carriage 32 is movable along the mast 28 to raise and lower a load on the platform assembly 34. The base assembly 26 includes an upwardly extending mast support 52 which is telescopically received in the lower end portion of the hollow mast 28. A gripper assembly 68 is provided to expand the mast support 52 to grip the inside of the hollow mast 28.

A cap assembly 30 is disposed on an upper end portion of the mast 28. The cap assembly 30 advantageously includes a downwardly extending mounting section 74 which is telescopically received in an upper end portion of the hollow mast 28. The downwardly extending mounting section 74 is expandable to grip the inside of the mast 28.

A brake assembly 44 is provided to hold the carriage 32 against downward movement along the mast 28 in the event of a loss of tension in a cable 40 which supports the carriage assembly. The brake assembly 44 includes a pair of elongated brake elements or bars 82 and 84 which are suspended from the cap assembly 30 in a spaced apart relationship with the mast 28. Brake members 270 and 272 on the carriage 32 are operable to grip the brake bars 82 and 84 and thereby support the carriage 32, in the event of a loss of tension in the cable 40.

Assembly of the stacker 20, at a location where the stacker is to be used is facilitated by forming the frame 50 of the stacker with accurately located wheel mounting surfaces 360 and 366. This enables wheel mounting units 376 and 380 to be connected directly to the frame 50 of the stacker 20.

The construction of the stacker 20 enables it to be readily assembled, disassembled and reassembled. Thus, the expandable mast support section 52 can be readily engaged with and disengaged from the lower end portion of the mast 28. Similarly, the expandable cap assembly mounting section 74 can be readily engaged with and disengaged from the upper end portion of the mast. The brake bars 82 and 84 can be accurately positioned relative to the lower end of the mast by the carriage 32. The wheel mounting units 376 and 380 are accurately positioned by engagement with side surfaces 360 and 366 of the frame 50.

Having described a specific preferred embodiment of the invention, the following is claimed:

1. An apparatus comprising a base, a hollow mast extending upwardly from said base, and a carriage movable up and down along said mast to raise and lower a load disposed on said carriage, said base including an upwardly extending mast support which is telescopically received in said mast and means for expanding said mast support to grip the inside of said mast, said means for expanding said mast support includes first and second wedge members disposed adjacent to a lower end portion of said mast support, third and fourth wedge members disposed adjacent to an upper end portion of said mast support, and means for effecting relative movement between said first and second wedge members to expand the lower end portion of said mast support and for effecting relative movement between said third and fourth wedge members to expand the upper end portion of said mast support.

2. An apparatus as set forth in claim 1 wherein said mast is a rectangular tube formed of a polymeric material and said base is primarily formed of metal.

3. An apparatus comprising a base, a hollow mast extending upwardly from said base, and a carriage movable up and down along said mast to raise and lower a load disposed on said carriage, said base including an upwardly extending mast support which is telescopically received in said mast and means for expanding said mast support to grip the inside of said mast, said means for expanding said mast support includes a first pair of wedges, a second pair of wedges disposed above said first pair of wedges, an elongated member extending between and connected with one of the wedges of said first pair of wedges and one of the wedges of said second pair of wedges, and screw means for effecting relative movement between wedges of said first pair of wedges and wedges of said second pair of wedges to press a flat side surface on said elongated member against an inner side surface of said mast.

4. An apparatus as set forth in claim 3 wherein said screw means includes a first screw member which is rotatable about a first axis to effect movement of one of the wedges of said first pair of wedges relative to said mast support and a second screw member which is rotatable about a second axis to effect movement of one of the wedges of said second pair of wedges relative to said mast support.

5. An apparatus as set forth in claim 4 wherein said mast support is hollow and said first and second screw members are disposed within said mast support and are rotatable about vertical axes which extend parallel to a vertical central axis of said mast support.

6. An apparatus as set forth in claim 3 further including spring means for urging at least one of said pairs of wedges toward an initial condition, said screw means being operable to effect relative movement between wedges of said one pair of wedges against the influence of said spring means.

7. An apparatus comprising a base, a hollow mast extending upwardly from said base, a carriage movable up and down along said mast to raise and lower a load disposed on said carriage, said base including an upwardly extending mast support which is telescopically received in said mast and means for expanding said mast support to grip the inside of said mast, a cap assembly connected with an upper end portion of said mast, an elongated brake element having an upper end portion connected with said cap assembly and a lower end portion connected with said base, said brake element being spaced apart from said mast throughout the length of said brake element between said cap assembly and said base, and a brake member mounted on said carriage for movement between a disengaged condition in which said brake member is ineffective to retard movement of said carriage and an engaged condition in which said brake member engages said brake element to retard movement of said carriage relative to said mast.

8. An apparatus as set forth in claim 7 wherein said carriage includes passage means through which said brake element extends and which is movable with said carriage during movement of said carriage along said brake element and said mast with said brake member in the disengaged condition.

9. An apparatus comprising a base, a hollow mast extending upwardly from said base, a carriage movable up and down along said mast to raise and lower a load disposed on said carriage, said base including an upwardly extending mast support which is telescopically received in said mast and means for expanding said mast support to grip the inside of said mast, cable means for at least partially supporting said carriage during movement of said carriage along said mast, a first brake bar extending along said mast, a second brake bar extending along said mast, said first and second brake bars having spaced apart flat side surfaces which are parallel and face toward each other, a first brake member mounted on said carriage between the flat side surfaces on said first and second brake bars and movable between a retracted position spaced from the flat side surface on said first brake bar and an engaged position engaging the flat side surface on said first brake bar, a second brake member mounted on said carriage between the flat side surfaces on said first and second brake bars and movable between a retracted position spaced from the flat side surface on the second brake bar and an engaged position engaging the flat side surface on the second brake bar, spring means mounted on said carriage between the flat side surfaces on said first and second brake bars for urging said first and second brake members toward their engaged positions, and retainer means connected with said cable means and mounted on said carriage means between the flat side surfaces on said first and second brake bars for retaining said first and second brake members in their retracted positions under the influence of force transmitted to said retainer means through said cable means and against the influence of said spring means.

10. An apparatus as set forth in claim 9 wherein said first and second brake bars are spaced apart from said mast an are free of connections to said mast between said base and an upper end portion of said mast.

11. An apparatus comprising a base, a hollow mast extending upwardly from said base, a carriage movable up and down along said mast to raise and lower a load disposed on said carriage, said base including an upwardly extending mast support which is telescopically received in said mast and means for expanding said mast support to grip the inside of said mast, including a longitudinally extending frame having a first end portion and a second end portion, said mast support extending upwardly from a central portion of said frame, said first end portion of said frame including a first mounting surface, said second end portion of said frame including a second mounting surface, said first and second mounting surfaces extending parallel to each other and to a longitudinal central axis of said frame, first wheel mounting means connected to said first end portion of said frame and disposed in abutting engagement with said first mounting surface for mounting a first wheel for rotation about a first axis which extends perpendicular to the longitudinal central axis of said frame, and second wheel mounting means connected to said second end portion of said frame and disposed in abutting engagement with said second mounting surface for mounting a second wheel for rotation about a second axis which extends perpendicular to the longitudinal central axis of said frame and parallel to said first axis.

12. An apparatus as set forth in claim 11 wherein said first wheel mounting means includes a one-piece support section having a flat side surface disposed in abutting engagement with said first mounting surface, a plurality of connectors interconnecting said support section and said frame, a wheel mounting section disposed in a telescopic relationship with said support section, and a plurality of rotatable bearing means disposed between telescoping portions of said wheel mounting section and said support section for supporting said wheel mounting section for rotation about said first axis.

13. An apparatus as set forth in claim 12 further including motor means mounted on said frame adjacent to said first wheel mounting means for providing force to rotate said first wheel, and drive means connected with said motor means and said wheel mounting section for transmitting force from said motor means to said wheel mounting section to rotate said wheel mounting section relative to said frame.

14. An apparatus as set forth in claim 11 wherein said first mounting surface is offset in a first direction from the longitudinal central axis of said frame and facing away from the longitudinal central axis of said frame, said second mounting surface being offset in a second direction from the longitudinal central axis of said frame and facing away from the longitudinal central axis of said frame, said first mounting surface being disposed in a plane which extends parallel to a plane in which said second mounting surface is disposed, the longitudinal central axis of said frame being disposed between and extending parallel to the planes in which said first and second mounting surfaces are disposed.

15. An apparatus as set forth in claim 11 wherein the longitudinal axis of said frame extends through the first and second wheels.

16. An apparatus comprising a base, a mast extending upwardly from said base, a cap assembly disposed on an upper end portion of said mast, a carriage movable up and down along said mast to raise and lower a load, cable means extending downwardly from said cap assembly to said carriage for transmitting force to said carriage to move said carriage upwardly along said mast, said cable means being stressed in tension by force transmitted through said cable means, a brake element offset to one side of and spaced apart from said mast, said brake element extending upwardly from said base, through said carriage to said cap assembly, and brake means mounted on said carriage for engaging said brake element to hold said carriage against downward movement relative to said mast in the event of a loss of tension in said cable means.

17. An apparatus as set forth in claim 16 wherein said brake element transmits tension force from said carriage to said cap assembly independently of said cable means upon engagement of said brake means with said brake element.

18. An apparatus as set forth in claim 16 wherein said brake element is free of any connections with said mast along the length of said brake element between said base and said carriage and between said carriage and said cap assembly.

19. An apparatus as set forth in claim 16 wherein said brake element has a rectangular cross sectional configuration in a plane extending perpendicular to a longitudinal central axis of said brake element.

20. An apparatus as set forth in claim 16 wherein said mast is hollow, said cap assembly including a mounting section which is telescopically received in said mast and means for expanding said mounting section to grip the inside of said mast.

21. An apparatus as set forth in claim 20 wherein said base includes a mounting section which is telescopically received in said mast and means for expanding said mounting section of said base to grip the inside of said mast.

22. An apparatus as set forth in claim 20 wherein said means for expanding said mounting section of said cap assembly includes a first wedge member, a second wedge member and means for sliding said first wedge member along said second wedge member to cam one of said wedge members toward an inner side surface of said mast.

23. An apparatus as set forth in claim 20 wherein said means for expanding said mounting section of said cap assembly includes a first wedge, a second wedge disposed in engagement with said first wedge, and screw means for effecting relative movement between said first and second wedges to press at least one of said first and second wedges against an inner side surface of said mast.

24. An apparatus comprising a base, a hollow mast extending upwardly from said base, said base including an upwardly extending mast support which is telescopically received in a lower end portion of said mast and means for expanding said mast support to grip the inside of said mast, a cap assembly disposed on an upper end portion of said mast, said cap assembly including a downwardly extending mounting section which is telescopically received in an upper end portion of said mast and means for expanding said mounting section to grip the inside of said mast, a carriage movable up and down along said mast to raise and lower a load, cable means extending downwardly from said cap assembly to said carriage for applying force to said carriage to move said carriage upwardly along said mast, said cable means being stressed in tension by force transmitted from said carriage through said cable means, and brake means for holding said carriage against downward movement along said mast in the event of a loss of tension in said cable means, said brake means including first and second brake elements which are suspended from said cap assembly in a spaced apart relationship with said mast and which extend downwardly from said cap assembly through said carriage to said base and brake members on said carriage for gripping said first and second brake elements to at least partially support said carriage from said cap assembly in the event of a loss of tension in said cable means.

25. An apparatus as set forth in claim 24 wherein said means for expanding said mast support includes actuator means which is accessible from a lower side of said base and is operable to effect expansion of said mast support with said mast support telescopically disposed in said mast, said means for expanding said mounting section of said cap assembly including actuator means which is accessible from an upper side of said cap assembly and is operable to effect expansion of said mounting section with said mounting section telescopically disposed in said mast.

26. An apparatus as set forth in claim 24 further including means for connecting lower end portions of said first and second brake elements with said base with said lower end portions of said first and second brake elements spaced apart from said mast.

27. An apparatus as set forth in claim 26 wherein said first and second brake elements have longitudinal central axes which extend parallel to a longitudinal central axis of said mast, said cable means having a variable length section which extends upwardly from said carriage to said cap assembly, said variable length section of said cable means and said first and second brake elements being offset from said mast toward a load engaging portion of said carriage.

28. An apparatus as set forth in claim 24 wherein said cable means includes a variable length section which extends upwardly from said carriage to said cap assembly and is disposed midway between said first and second brake elements.

29. An apparatus comprising a base, said base including a longitudinally extending frame having a first end portion and a second end portion, a mast extending upwardly from said base and having a central axis extending perpendicular to a longitudinal central axis of said frame, said first end portion of said frame including a first flat mounting surface, said second end portion of said frame including a second flat mounting surface, said first and second mounting surfaces extending parallel to each other and to the longitudinal central axis of said frame, first wheel mounting means connected to said first end portion of said frame and disposed in abutting engagement with said first mounting surface for mounting a first wheel for rotation about a first axis which extends perpendicular to the longitudinal central axis of said frame, and second wheel mounting means connected to said second end portion of said frame and disposed in abutting engagement with said second mounting surface for mounting a second wheel for rotation about a second axis which extends perpendicular to the longitudinal central axis of said frame and which extends parallel to said first axis.

30. An apparatus as set forth in claim 29 wherein said first wheel mounting means includes a one-piece support section having a flat side surface disposed in abutting engagement with said first mounting surface, a plurality of connectors interconnecting said support section and said frame, a wheel mounting section disposed in a telescopic relationship with said support section, and a plurality of rotatable bearing means disposed between telescoping portions of said wheel mounting section and said support section for supporting said wheel mounting section for rotation about said first axis.

31. An apparatus as set forth in claim 30 further including motor means mounted on said frame adjacent to said first wheel mounting means for providing force to rotate said first wheel, and drive means connected with said motor means and said wheel mounting section for transmitting force from said motor means to said wheel mounting section to rotate said wheel mounting section relative to said frame.

32. An apparatus as set forth in claim 29 wherein said first mounting surface is offset in a first direction from the longitudinal central axis of said frame and facing away from the longitudinal central axis of said frame, said second mounting surface being offset in a second direction from the longitudinal central axis of said frame and facing away from the longitudinal central axis of said frame, said first mounting surface being disposed in a plane which extends parallel to a plane in which said second mounting surface is disposed, the longitudinal central axis of said frame being disposed between and extending parallel to the planes in which said first and second mounting surfaces are disposed.

33. An apparatus as set forth in claim 29 wherein the longitudinal axis of said frame extends through the first and second wheels.

34. An apparatus comprising a base, a mast extending upwardly from said base, a carriage movable up and down along said mast to raise and lower a load disposed on said carriage, cable means connected with said carriage means and supported by an upper end portion of said mast for at least partially supporting said carriage during movement of said carriage along said mast, and brake means for preventing downward movement of said carriage along said mast in the event of a loss of tension in said cable means, said brake means including a first brake bar extending along said mast, a second brake bar extending along said mast, said first and second brake bars having spaced apart flat side surfaces which face toward each other, a first brake member mounted on said carriage between the flat side surfaces on said first and second brake bars and movable between a retracted position spaced from the flat side surface on said first brake bar and an engaged position engaging the flat side surface on said first brake bar, and a second brake member mounted on said carriage between the flat side surfaces on said first and second brake bars and movable between a retracted position spaced from the flat side surface on said second brake bar and an engaged position engaging the flat side surface on said second brake bar.

35. An apparatus as set forth in claim 34 further including a first backing member mounted on said carriage and engageable with a side of said first brake bar opposite from the flat side surface on said first brake bar to enable said first brake bar to be gripped between said first backing member and said first brake member when said first brake member is in the engaged position, and a second backing member mounted on said carriage and engageable with a side of said second brake bar opposite from the flat side surface on said second brake bar to enable said second brake bar to be gripped between said second backing member and said second brake member when said second brake member is in the engaged position.

36. An apparatus as set forth in claim 34 further including means for connecting said cable means with said carriage at a location between the flat side surfaces on said first and second brake bars.

37. An apparatus as set forth in claim 34 wherein said first and second brake bars have upper end portions connected with the upper end portion of said mast, said first and second brake bars being spaced apart from said mast throughout the length of said first and second brake bars.

38. An apparatus as set forth in claim 34 wherein said base includes an upwardly extending mast support which is telescopically received in said mast and means for expanding said mast support to grip the inside of said mast.

39. An apparatus as set forth in claim 34 further including a cap assembly disposed at an upper end portion of said mast, said cap assembly including an upper end portion, a downwardly extending cap support which is connected to said upper end portion and is telescopically received in said mast and means for expanding said cap support to grip the inside of said mast, said first and second brake bars being connected to said upper end portion of said cap assembly.

40. An apparatus as set forth in claim 39 further including spring means mounted on said carriage for urging said first and second brake members toward their engaged positions, and retainer means connected with said cable means for retaining said first and second brake members in their retracted positions under the influence of force transmitted to said retainer means through said cable means and against the influence of said spring means.

41. An apparatus as set forth in claim 39 wherein said base includes a longitudinally extending frame having a first end portion and a second end portion, said mast extending upwardly from a central portion of said frame, said first end portion including a first mounting surface, said second end portion including a second mounting surface, said first and second mounting surfaces extending parallel to each other and to a longitudinal central axis of said frame, first wheel mounting means connected to said first end portion of said frame and disposed in abutting engagement with said first mounting surface for mounting a first wheel for rotation about a first axis which extends perpendicular to the longitudinal central axis of said frame, and second wheel mounting means connected to said second end portion of said frame and disposed in abutting engagement with said second mounting surface for mounting a second wheel for rotation about a second axis which extends perpendicular to the longitudinal central axis of said frame and parallel to said first axis.

42. An apparatus comprising a base, a hollow mast extending upwardly from said base, a carriage movable up and down along said mast to raise and lower a load disposed on said carriage, said base including an upwardly extending mast support which is telescopically received in said mast and means for expanding said mast support to grip the inside of said mast, an elongated element extending upwardly from said base along the outside of and spaced apart from said mast, and brake means connected with said carriage for engaging said elongated element to hold said carriage against downward movement relative to said mast.

43. An apparatus as set forth in claim 42 further including a cap assembly disposed at an upper end portion of said mast, said cap assembly including a downwardly extending cap support which is telescopically received in said mast and means for expanding said cap support to grip the inside of said mast.

44. An apparatus as set forth in claim 42 wherein said hollow mast has first and second vertical side walls which are spaced apart and extend parallel to each other and third and fourth vertical side walls which are spaced apart and extend perpendicular to said first and second vertical side walls, said carriage including surface means for supporting a load adjacent to said first side wall, said means for expanding said mast support to grip the inside of said mast including means for pressing flat side surfaces on said mast support against inner sides of said first and second side walls.

45. An apparatus as set forth in claim 42 wherein said mast support has a lower end portion and an upper end portion, said means for expanding said mast support including means for expanding the lower end portion of said mast support to grip the inside of a lower end portion of said mast and for expanding the upper end portion of said mast support after expansion of the lower end portion of said mast support to grip the inside of said mast at a location above the lower end portion of said mast after the inside of the lower end portion of said mast has been gripped.

46. An apparatus as set forth in claim 42 wherein said means for expanding said mast support includes a first wedge member, a second wedge member, and means for sliding said first wedge member along said second wedge member to cam one of said wedge members toward an inner side surface of said mast.

47. An apparatus as set forth in claim 42 wherein said means for expanding said mast support includes first and second wedge members disposed adjacent to a lower end portion of said mast support, third and fourth wedge members disposed adjacent to an upper end portion of said mast support, and means for effecting relative movement between said first and second wedge members to expand the lower end portion of said mast support and for effecting relative movement between said third and fourth wedge members to expand the upper end portion of said mast support.

48. An apparatus as set forth in claim 42 wherein said mast is a rectangular tube formed of a polymeric material and said base is primarily formed of metal.

49. An apparatus comprising a base, a hollow mast extending upwardly from said base, a carriage movable up and down along said mast to raise and lower a load disposed on said carriage, said base including an upwardly extending mast support which is telescopically received in said mast and means for expanding said mast support to grip the inside of said mast, and a cap assembly disposed at an upper end portion of said mast, said cap assembly including a downwardly extending cap support which is telescopically received in said mast and means for expanding said cap support to grip the inside of said mast.

50. An apparatus as set forth in claim 49 wherein said hollow mast has first and second vertical side walls which are spaced apart and extend parallel to each other and third and fourth vertical side walls which are spaced apart and extend perpendicular to said first and second vertical side walls, said carriage including surface means for supporting a load adjacent to said first side wall, said means for expanding said mast support to grip the inside of said mast including means for pressing flat side surfaces on said mast support against inner sides of said first and second side walls.

51. An apparatus as set forth in claim 49 wherein said mast support has a lower end portion and an upper end portion, said means for expanding said mast support including means for expanding the lower end portion of said mast support to grip the inside of a lower end portion of said mast and for expanding the upper end portion of said mast support after expansion of the lower end portion of said mast support to grip the inside of said mast at a location above the lower end portion of said mast after the inside of the lower end portion of said mast has been gripped.

52. An apparatus as set forth in claim 49 wherein said means for expanding said mast support includes a first wedge member, a second wedge member, and means for sliding said first wedge member along said second wedge member to cam one of said wedge members toward an inner side surface of said mast.

53. An apparatus as set forth in claim 49 wherein said means for expanding said mast support includes first and second wedge members disposed adjacent to a lower end portion of said mast support, third and fourth wedge members disposed adjacent to an upper end portion of said mast support, and means for effecting relative movement between said first and second wedge members to expand the lower end portion of said mast support and for effecting relative movement between said third and fourth wedge members to expand the upper end portion of said mast support.

54. An apparatus as set forth in claim 49 wherein said mast is a rectangular tube formed of a polymeric material and said base is primarily formed of metal.

55. An apparatus as set forth in claim 49 further including cable means for at least partially supporting said carriage during movement of said carriage along said mast and brake means for preventing movement of said carriage along said mast, said brake means including means for transmitting force upwardly from said carriage to said cap assembly along a force transmission path which is spaced apart from the mast at least until the force transmission path is adjacent to the upper end portion of the mast.

56. An apparatus as set forth in claim 49 further including an elongated brake element having an upper end portion connected with said cap assembly and a lower end portion connected with said base, said brake element being spaced apart from said mast throughout the length of said brake element between said cap assembly and said base, a brake member mounted on said carriage for movement between a disengaged condition in which said brake member is ineffective to retard movement of said carriage and an engaged condition in which said brake member engages said brake element to retard movement of said carriage relative to said mast.

57. An apparatus as set forth in claim 56 wherein said carriage includes passage means through which said brake element extends and which is movable with said carriage during movement of said carriage along said brake element and said mast with said brake member in the disengaged condition.

58. An apparatus as set forth in claim 49 further including cable means extending downwardly from said cap assembly for transmitting force to move said carriage upwardly along said mast, a brake element extending upwardly from said base to said cap assembly, and brake means mounted on said carriage for engaging aid brake element to hold said carriage against downward movement relative to said mast.

59. An apparatus comprising a base, a hollow mast extending upwardly from said base, and a carriage movable up and down along said mast to raise and lower a load disposed on said carriage, said base including an upwardly extending mast support which is telescopically received in said mast and means for expanding said mast support to grip the inside of said mast, said hollow mast has first and second vertical side walls which are spaced apart and extend parallel to each other and third and fourth vertical side walls which are spaced apart and extend perpendicular to said first and second vertical side walls, said carriage including surface means for supporting a load adjacent to said first side wall, said means for expanding said mast support to grip the inside of said mast including means for pressing flat side surfaces on said mast support against inner sides of said first and second side walls.

60. An apparatus as set forth in claim 59 further including an elongated element extending upwardly from said base along the outside of and spaced apart from said mast, and brake means connected with said carriage for engaging said elongated element to hold said carriage against downward movement relative to said mast.

61. An apparatus as set forth in claim 59 further including a cap assembly disposed at an upper end portion of said mast, said cap assembly including a downwardly extending cap support which is telescopically received in said mast and means for expanding said cap support to grip the inside of said mast.

62. An apparatus as set forth in claim 59 wherein said first, second, third and fourth vertical side walls of said mast are formed of a polymeric material.

63. An apparatus as set forth in claim 59 further including a cap assembly disposed at an upper end portion of said mast, said cap assembly including a downwardly extending cap support which is telescopically received in said mast, said cap support including means for pressing flat side surfaces on said cap support against the inner sides of the first and second side walls.

64. An apparatus as set forth in claim 63 wherein said first, second, third, and fourth vertical side walls of said mast are formed of a polymeric material.

65. An apparatus comprising a base, a hollow mast extending upwardly from said base, and a carriage movable up and down along said mast to raise and lower a load disposed on said carriage, said base including an upwardly extending mast support which is telescopically received in said mast and means for expanding said mast support to grip the inside of said mast, said mast support having a lower end portion and an upper end portion, said means for expanding said mast support including means for expanding the lower end portion of said mast support to grip the inside of a lower end portion of said mast and for expanding the upper end portion of said mast support after expansion of the lower end portion of said mast support to grip the inside of said mast at a location above the lower end portion of said mast after the inside of the lower end portion of said mast has been gripped.

66. An apparatus as set forth in claim 65 wherein said means for expanding said lower end portion of said mast support and for expanding said upper end portion of said mast support includes first and second wedge members disposed adjacent to a lower end portion of said mast support, third and fourth wedge members disposed adjacent to an upper end portion of said mast support.

67. An apparatus as set forth in claim 66 wherein said mast is a rectangular tube formed of a polymeric material and said base is primarily formed of metal.

68. An apparatus as set forth in claim 65 wherein said means for expanding said lower end portion of said mast support and for expanding said upper end portion of said mast support includes a first pair of wedges, a second pair of wedges disposed above said first pair of wedges, and an elongated member extending between and connected with one of the wedges of said first pair of wedges and one of the wedges of said second pair of wedges.

69. An apparatus comprising a base, a hollow mast extending upwardly from said base, and a carriage movable up and down along said mast to raise and lower a load disposed on said carriage, said base including an upwardly extending mast support which is telescopically received in said mast and means for expanding said mast support to grip the inside of said mast, said means for expanding said mast support includes a first wedge member, a second wedge member, and means for sliding said first wedge member along said second member to cam one of said wedge members toward an inner side surface of said mast.

70. An apparatus comprising a base, a hollow mast extending upwardly from said base, a carriage movable up and down along said mast to raise and lower a load disposed on said carriage, said base including an upwardly extending mast support which is telescopically received in said mast and means for expanding said mast support to grip the inside of said mast, cable means for at least partially supporting said carriage during movement of said carriage along said mast, and brake means for preventing movement of said carriage along said mast in the event of a loss of tension in said cable means, said brake means including means for transmitting force upwardly from said carriage to an upper end portion of said mast along a force transmission path which is spaced apart from the mast at least until the force transmission path is adjacent to the upper end portion of the mast.

71. An apparatus as set forth in claim 70 said means for transmitting force includes an elongated element extending upwardly from said base along the outside of and spaced apart from said mast, said brake means further including means connected with said carriage for engaging said elongated element to hold said carriage against downward movement relative to said mast.

72. An apparatus as set forth in claim 70 further including a cap assembly disposed at an upper end portion of said mast, said cap assembly including a downwardly extending cap support which is telescopically received in said mast, said cable means and said means for transmitting force being connected with said cap assembly.

73. An apparatus as set forth in claim 70 wherein said hollow mast has first and second vertical side walls which are spaced apart and extend parallel to each other and third and fourth vertical side walls which are spaced apart and extend perpendicular to said first and second vertical side walls, said carriage including surface means for supporting a load adjacent to said first side wall, said means for expanding said mast support to grip the inside of said mast including means for pressing flat side surfaces on said mast support against inner sides of said first and second side walls.

74. An apparatus as set forth in claim 70 wherein said mast support has a lower end portion and an upper end portion, said means for expanding said mast support including means for expanding the lower end portion of said mast support to grip the inside of a lower end portion of said mast and for expanding the upper end portion of said mast support after expansion of the lower end portion of said mast support to grip the inside of said mast at a location above the lower end portion of said mast after the inside of the lower end portion of said mast has been gripped.

75. An apparatus as set forth in claim 70 wherein said means for expanding said mast support includes a first wedge member, a second wedge member, and means for sliding said first wedge member along said second wedge member to cam one of said wedge members toward an inner side surface of said mast.

76. An apparatus as set forth in claim 70 wherein said means for expanding said mast support includes first and second wedge members disposed adjacent to a lower end portion of said mast support, third and fourth wedge members disposed adjacent to an upper end portion of said mast support, and means for effecting relative movement between said first and second wedge members to expand the lower end portion of said mast support and for effecting relative movement between said third and fourth wedge members to expand the upper end portion of said mast support.

77. An apparatus as set forth in claim 70 wherein said mast is a rectangular tube formed of a polymeric material and said base is primarily formed of metal.

78. An apparatus as set forth in claim 70 further including a cap assembly connected with an upper end portion of said mast, said means for transmitting force having an upper end portion connected with said cap assembly and a lower end portion connected with said base, said means for transmitting force being spaced apart from said mast between said cap assembly and said base, said brake means including a brake member mounted on said carriage and engageable with said means for transmitting force to retard movement of said carriage relative to said mast.

79. An apparatus as set forth in claim 70 wherein said means for transmitting force includes an elongated member which is spaced apart from said mast and is free of connections to said mast between said base and an upper end portion of said mast.

* * * * *